US008292648B2

(12) United States Patent
Kiryu et al.

(10) Patent No.: US 8,292,648 B2
(45) Date of Patent: Oct. 23, 2012

(54) FLEXIBLE CABLE CONNECTING STRUCTURE AND FLEXIBLE CABLE CONNECTOR

(75) Inventors: Koichi Kiryu, Shimotakai-gun (JP); Koki Sato, Shinagawa (JP); Miki Kitahara, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 161 days.

(21) Appl. No.: 12/753,231

(22) Filed: Apr. 2, 2010

(65) Prior Publication Data

US 2010/0291790 A1 Nov. 18, 2010

(30) Foreign Application Priority Data

May 12, 2009 (JP) ..... 2009-115767

(51) Int. Cl.
*H01R 12/24* (2006.01)

(52) U.S. Cl. ..... 439/328; 439/357; 439/495

(58) Field of Classification Search ..... 439/495, 439/496, 328, 357

See application file for complete search history.

(56) References Cited

U.S. PATENT DOCUMENTS

| | | | | | |
|---|---|---|---|---|---|
| 3,573,706 | A | * | 4/1971 | Haberlen | 439/328 |
| 3,731,252 | A | * | 5/1973 | McKeown et al. | 439/59 |
| 3,993,383 | A | * | 11/1976 | Marino | 439/848 |
| 4,018,495 | A | * | 4/1977 | Freitag | 439/55 |
| 4,129,351 | A | * | 12/1978 | Sugimoto et al. | 439/325 |
| 4,337,989 | A | * | 7/1982 | Asick et al. | 439/607.23 |
| 4,509,811 | A | * | 4/1985 | Amano et al. | 439/77 |
| 5,052,943 | A | * | 10/1991 | Davis | 439/357 |
| 5,308,262 | A | * | 5/1994 | Chishima | 439/495 |
| 5,660,557 | A | * | 8/1997 | Lemke et al. | 439/328 |
| 5,839,916 | A | * | 11/1998 | Chishima | 439/495 |
| 5,904,589 | A | * | 5/1999 | Asakawa | 439/495 |
| 6,234,827 | B1 | * | 5/2001 | Nishio et al. | 439/357 |
| 6,482,027 | B2 | * | 11/2002 | Ishii et al. | 439/495 |
| 6,554,648 | B2 | * | 4/2003 | Shi et al. | 439/607.55 |
| 6,659,794 | B2 | * | 12/2003 | Yamatani et al. | 439/495 |
| 6,902,432 | B2 | * | 6/2005 | Morikawa et al. | 439/607.41 |
| 7,247,047 | B2 | * | 7/2007 | Baranski et al. | 439/495 |
| 7,255,584 | B2 | * | 8/2007 | Takashita | 439/260 |
| 7,507,112 | B2 | * | 3/2009 | Mundt | 439/495 |
| 7,510,424 | B2 | * | 3/2009 | Mundt | 439/492 |
| 7,625,231 | B2 | * | 12/2009 | Takahira | 439/495 |
| 7,837,497 | B1 | * | 11/2010 | Matsuo et al. | 439/492 |
| 8,113,872 | B2 | * | 2/2012 | Takahashi et al. | 439/495 |
| 8,192,219 | B2 | * | 6/2012 | Satoh | 439/328 |
| 2004/0102083 | A1 | * | 5/2004 | Kuroda et al. | 439/495 |
| 2010/0291790 | A1 | * | 11/2010 | Kiryu et al. | 439/374 |

FOREIGN PATENT DOCUMENTS

| | | | |
|---|---|---|---|
| JP | 3-139151 | * | 6/1991 |
| JP | 6-45036 | | 2/1994 |

* cited by examiner

*Primary Examiner* — Neil Abrams
(74) *Attorney, Agent, or Firm* — IPUSA, PLLC

(57) ABSTRACT

A flexible cable connecting structure includes a terminal part including a plurality of conductive patterns, the conductive patterns being formed at an end part of a flexible cable; a plurality of connector pins that are provided side by side inside a connector, the connector pins being configured to be connected to the terminal part; a cable side guide part fixed at a rear surface of the terminal part of the flexible cable; and a connector side guide part provided at a cable inserting opening of the connector, the connector side guide part being configured to guide inserting and detaching of the cable side guide part. The cable side guide part slides on the connector side guide part when the cable side guide part is being inserted into the cable inserting opening of the connector, so that the inserting and detaching of the cable side guide part is guided.

8 Claims, 26 Drawing Sheets

FLEXIBLE CABLE CONNECTING STRUCTURE AND FLEXIBLE CABLE CONNECTOR

CROSS-REFERENCE TO RELATED APPLICATIONS

This patent application is based upon and claims the benefit of priority of Japanese Patent Application No. 2009-115767 filed on May 12, 2009 the entire contents of which are incorporated herein by reference.

BACKGROUND OF THE INVENTION

1. Field of the Invention

The present invention generally relates to flexible cable connecting structures and flexible cable connectors. More specifically, the present invention relates to a flexible cable connecting structure whereby corresponding terminals of a flexible cable and a connector are connected to each other and a flexible cable connector.

2. Description of the Related Art

As a flexible cable, for example, a belt-shaped cable such as a FFC (Flexible Flat Cable) or FPC (Flexible Printed Circuit) has been used. Such a belt-shaped cable, which is thin, has a structure where insulation layers are stacked on upper and lower surfaces of a conductive layer and has flexibility.

In such a flexible cable, plural terminals having both end parts where the conductive layer is exposed are arranged in parallel. The flexible cable, like a sheet, is thin. In the flexible cable, plural conductive patterns are provided side by side at designated narrow pitches between the insulation layers which are widely formed.

In addition, a cable inserting opening of a connector, corresponding to a configuration of the cable, is thin and wide. Furthermore, a reinforcing plate is stacked on rear surfaces of the plural terminals in order to improve the strength at the time when the connector is inserted.

In a connecting structure where such a flexible cable is connected, plural connector pins configured to contact the cable terminals are provided inside the cable inserting opening side by side with the same pitch as that of the conductive patterns at a cable side.

Accordingly, by inserting a terminal part of the flexible cable into the cable inserting opening of the connector, the terminals of the conductive patterns of the flexible cable are sandwiched between the connector pins by contact pressure of the connector pins and electrically connected with the corresponding connector pins. See, for example, Japanese Laid-Open Patent Application Publication No. 6-45036.

In the above-mentioned related art flexible cable connecting structure, since the flexible cable itself has flexibility, when the terminal part of the flexible cable is inserted into the cable inserting opening of the connector, the flexible cable may be curved in a case where an inserting force is applied to the connector. Therefore, while the reinforcing plate is grasped, the terminal part of the flexible cable is inserted into the cable inserting opening of the connector.

However, the terminal part of the flexible cable is thin and therefore the reinforcing plate has a configuration whereby it is difficult to grasp the reinforcing plate. Hence, it is difficult to insert the terminal part of the flexible cable into the cable inserting opening of the connector in a straight manner.

In addition, in a case where the terminal part of the flexible cable is inserted in the cable inserting opening while the terminal part is inclined in right and left directions, an extending direction of the conductive patterns of the terminal part faces an extending direction of the connector pins in an inclining state. Accordingly, the conductive patterns and the corresponding connector pins do not securely make contact with each other. In the related art flexible cable connecting structure, an operator performing assembling operations cannot confirm, from outside, a connection state inside of the connector. Accordingly, the operator performs the assembling operations without knowing how the conductive patterns and the corresponding connector pins have come in contact with each other.

SUMMARY OF THE INVENTION

Accordingly, embodiments of the present invention may provide a novel and useful flexible cable connecting structure and a flexible cable connector solving one or more of the problems discussed above.

More specifically, the embodiments of the present invention may provide a flexible cable connecting structure, including:

a terminal part including a plurality of conductive patterns, the conductive patterns being formed at an end part of a flexible cable;

a plurality of connector pins that are provided side by side inside a connector, the connector pins being configured to be connected to the terminal part;

a cable side guide part fixed at a rear surface of the terminal part of the flexible cable; and a connector side guide part provided at a cable inserting opening of the connector, the connector side guide part being configured to guide inserting and detaching of the cable side guide part, wherein the cable side guide part slides on the connector side guide part when the cable side guide part is being inserted into the cable inserting opening of the connector, so that the inserting and detaching of the cable side guide part is guided.

Another aspect of the embodiments of the present invention may be to provide a flexible cable connector, including:

a cable inserting opening where a terminal part is inserted, the terminal part including a plurality of conductive patterns, the conductive patterns being formed at an end part of a flexible cable;

a plurality of connector pins that are provided side by side at an internal wall of the cable inserting opening, the connector pins being configured to be connected to the terminal part; and a connector side guide part configured to guide inserting and detaching of the cable side guide part, the cable side guide part being fixed at a rear surface of the terminal part of the flexible cable, wherein, the cable side guide part is inserted into the cable inserting opening of the connector; and the connector side guide part guides an inserting and detaching position by sliding with the cable side guide part.

Additional objects and advantages of the embodiments are set forth in part in the description which follows, and in part will become obvious from the description, or may be learned by practice of the invention. The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

A description is given below, with reference to the FIG. 1 through FIG. 15 of embodiments of the present invention.

[First Embodiment]

Figure 1:
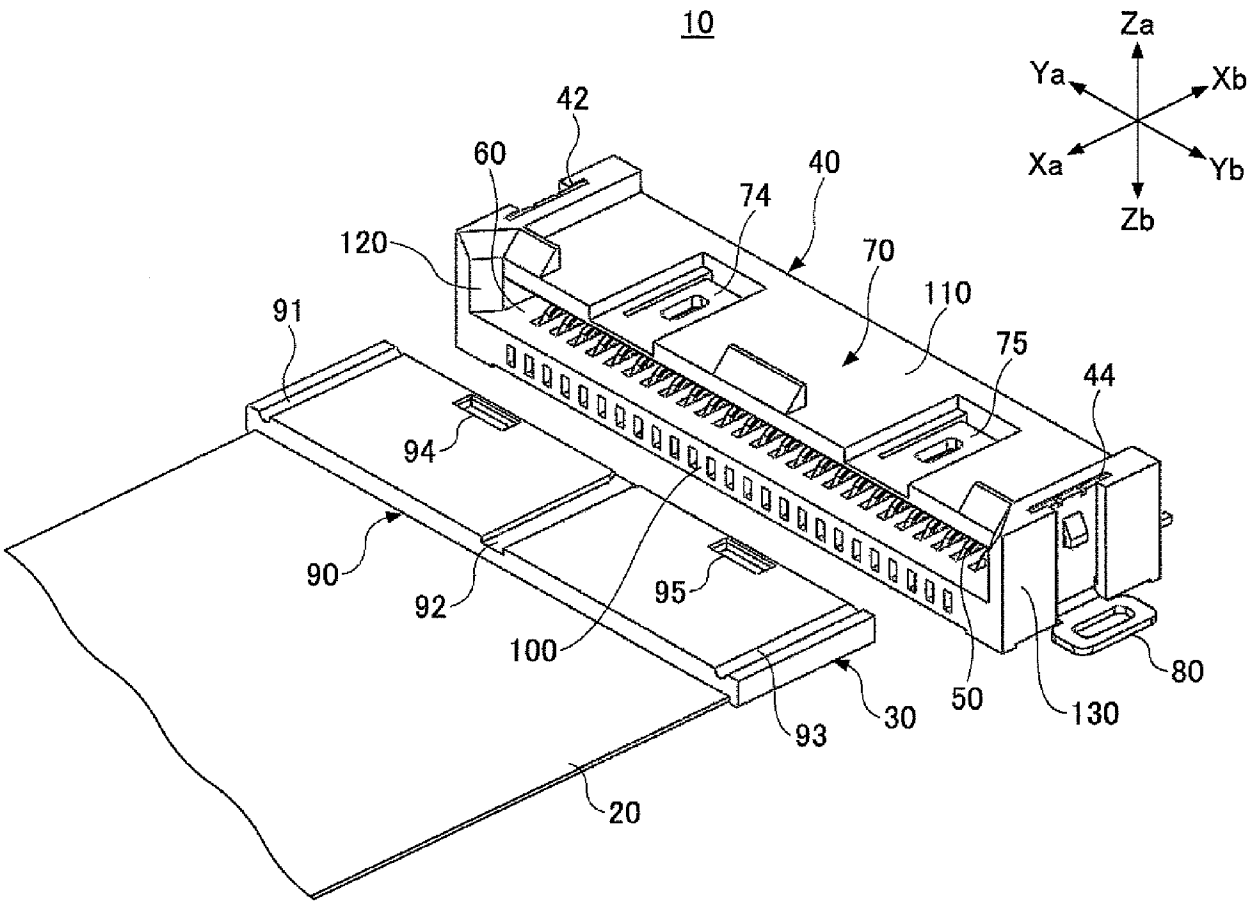
FIG. 1 is an exploded perspective view of a flexible cable connecting structure of an embodiment of the present invention.

FIG. 1 is an exploded perspective view of a flexible cable connecting structure of an embodiment of the present invention.

As shown in FIG. 1, in a flexible cable connecting structure 10, by inserting a terminal part 30 formed at an end part of a flexible cable 20 into a cable inserting opening 60 of a flexible cable connector (hereinafter "connector") 40, plural connector pins 50 arranged side by side at a lower side of the cable inserting opening 60 are connected to the terminal part 30.

The connector 40 is fixed onto a printed wiring board. End parts of the connector pins 50 extending to a bottom part of the connector 40 are soldered to a connecting pattern formed on the printed wiring board.

The connector 40 of the first embodiment of the present invention is a bottom contact type connector where the plural connector pins 50 are arranged side by side at a lower side of the cable inserting opening 60 and a connector side guide part 70 is provided at an upper side of the cable inserting opening 60.

Accordingly, the connector side guide part 70 is integrally molded with the connector 40 so as to form the upper side of the cable inserting opening 60. In addition, L-shaped brackets 80 made of metal are press-fitted in fixing grooves 42 and 44 situated at left and right side surfaces, respectively, of the connector 40 so that the connector 40 is fixed to the printed wiring board.

Here, a structure of the flexible cable 20 is discussed with reference to FIG. 2A through FIG. 2D.

Figure 2A:
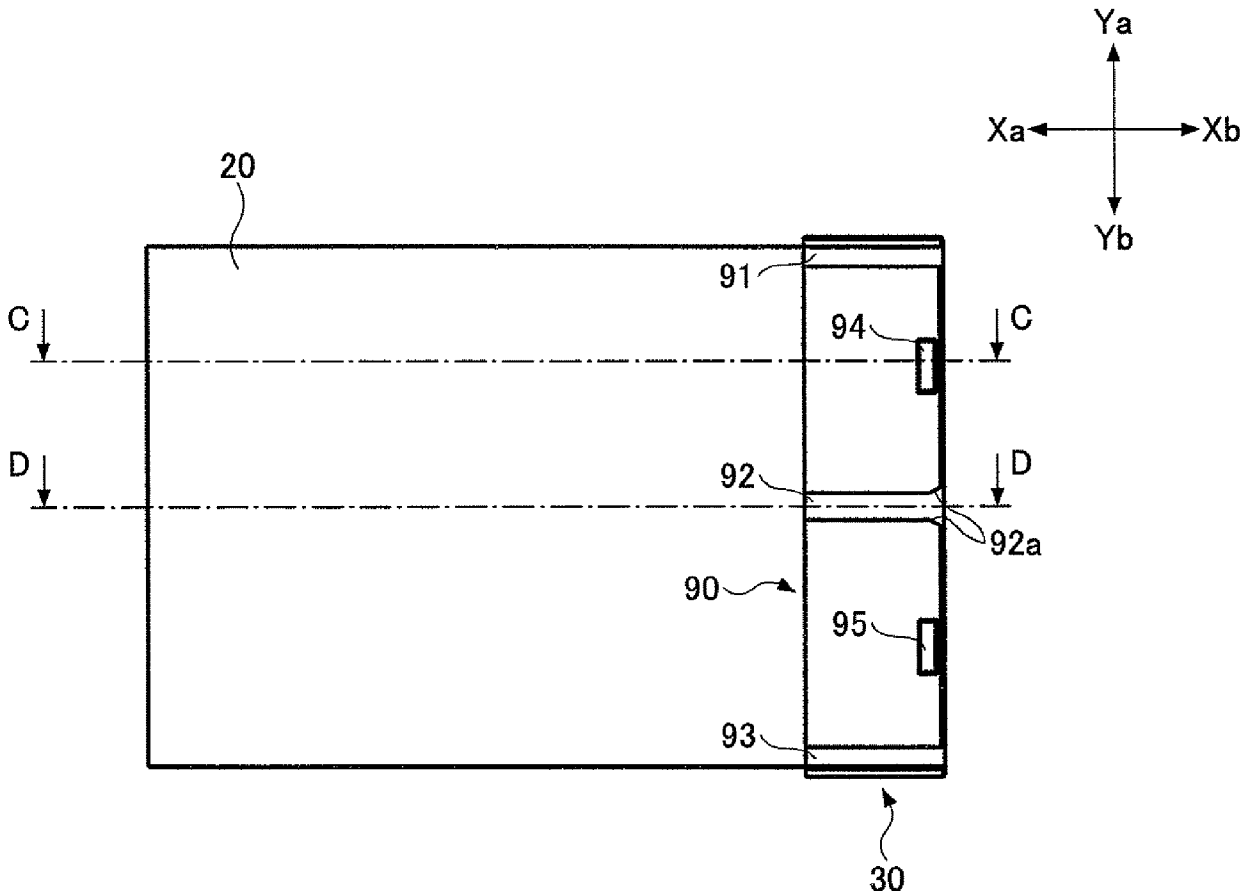
FIG. 2A is a plan view of a flexible cable seen from an upper side.
Figure 2B:
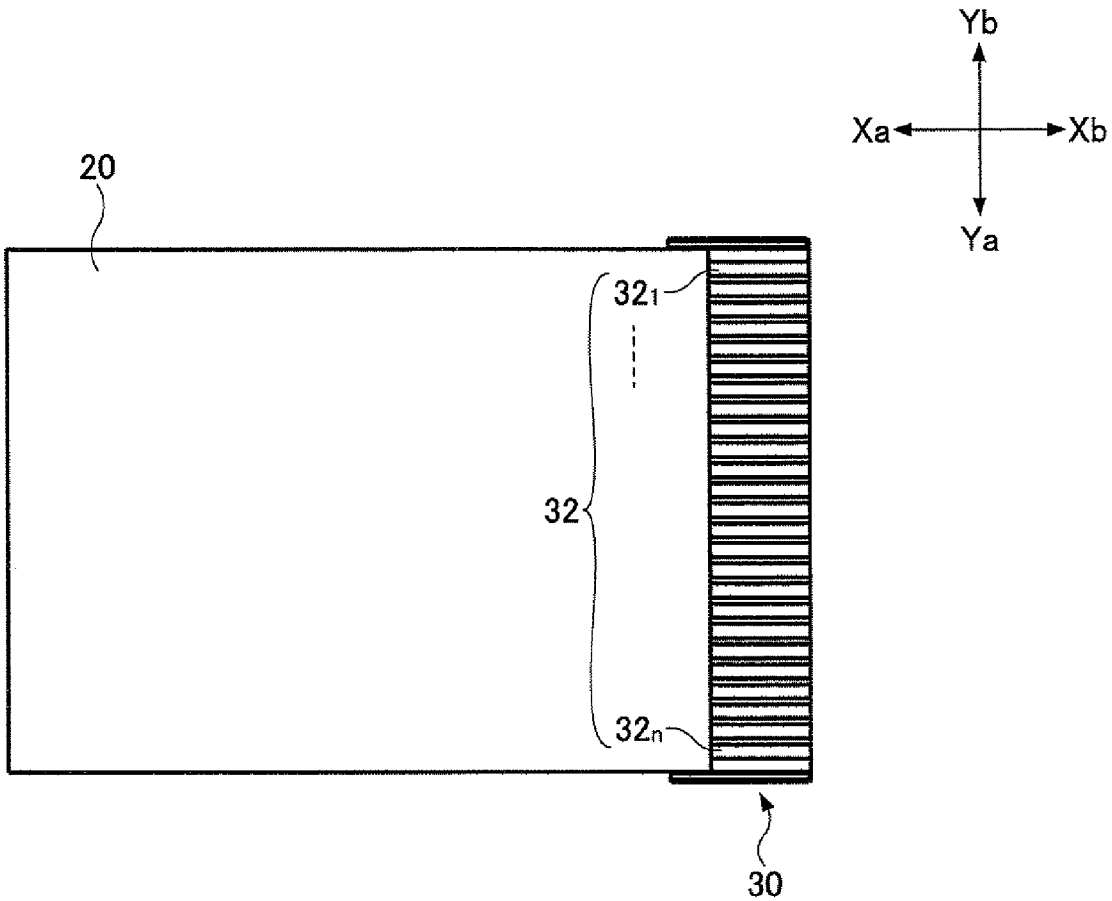
FIG. 2B is a bottom view of the flexible cable seen from a lower side.
Figure 2C:
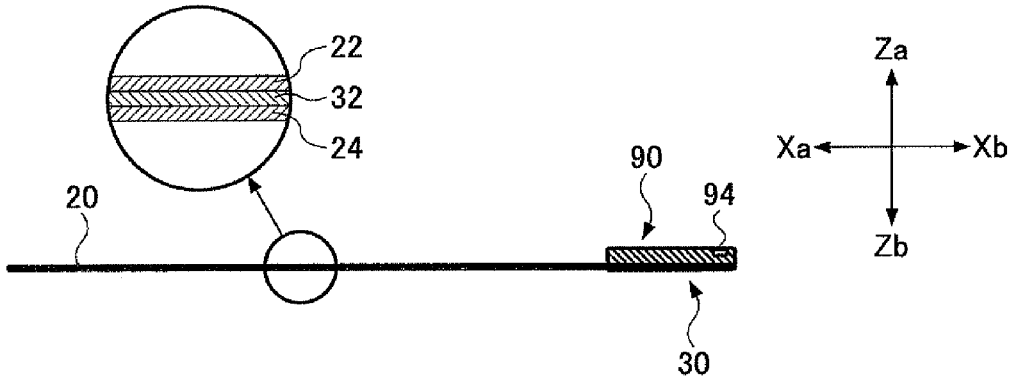
FIG. 2C is a vertical cross-sectional view of the flexible cable taken along a line C-C in FIG. 2A.
Figure 2D:
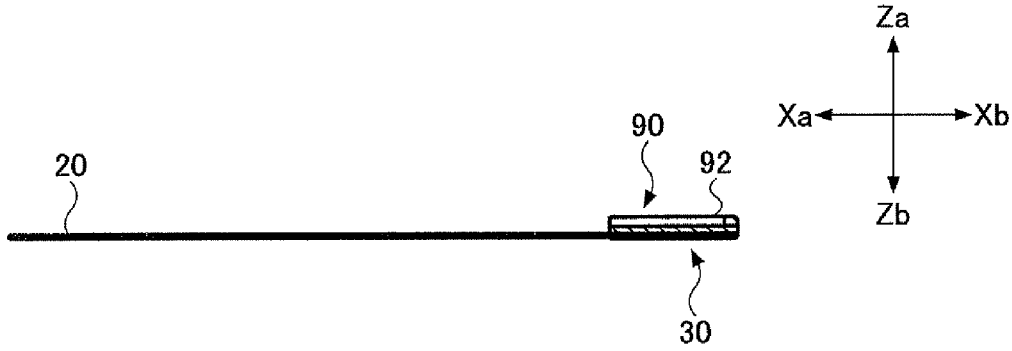
FIG. 2D is a vertical cross-sectional view of the flexible cable taken along a line D-D in FIG. 2A.

FIG. 2A is a plan view of the flexible cable 20 seen from an upper side. FIG. 2B is a bottom view of the flexible cable 20 seen from a lower side. FIG. 2C is a vertical (side) cross-sectional view of the flexible cable 20 taken along a line C-C in FIG. 2A. FIG. 2D is a vertical cross-sectional view of the flexible cable 20 taken along a line D-D in FIG. 2A.

As shown in FIG. 2A through FIG. 2D, the flexible cable 20 is a thin belt-shaped cable having flexibility, and is called a FFC (Flexible Flat Cable). In the flexible cable 20, the terminal part 30 is formed at a lower surface end part. A cable side guide part 90 is fixed to an upper surface end part of the flexible cable 20 and is situated at a rear side of (back-to-back with) the terminal part 30.

In addition, in the flexible cable 20, plural conductive patterns 32 ($32_1$~$32_n$) are formed in parallel at a lower surface of an insulation layer 22 made of, for example, polyester resin. The plural conductive patterns 32 ($32_1$~$32_n$), excluding an exposed part whose lower surface is the terminal part 30, are covered with an insulation layer 24 made of, for example polyester resin.

Thus, the flexible cable 20 has a three layer structure where the insulation layers 22 and 24 are stacked on the upper and lower surfaces, respectively, of the plural conductive patterns 32 ($32_1$~$32_n$). In addition, the flexible cable 20 is thin like a sheet. Hence, the flexible cable 20 can be bent in upper and lower directions.

The cable side guide part 90 fixed to an upper surface end part of the flexible cable 20 is integrally molded of a resin material. Guide grooves (restricted parts) 91 through 93 extending in inserting and detaching directions (Xa and Xb directions) are formed in three portions, namely at vicinities of left and right sides and a center of an upper surface of the cable side guide part 90.

In addition, engaging holes 94 and 95 as engaged parts are provided in the vicinity of the upper surface end part of the cable side guide part 90. The engaging holes 94 and 95 are formed in positions separated in left and right directions (Ya and Yb directions). The engaging holes 94 and 95 are formed as rectangular-shaped concave parts indented in upper and lower directions (Za and Zb directions).

The guide groove 92 is formed in the center of the upper surface of the cable side guide part 90. The guide groove 92 includes a taper part 92*a* inclining in a wider manner toward the inserting end part. Since the entrance side of the taper part 92*a* of the cable side guide part 90 is wide, it is possible to accommodate positional shifts in the left and right directions (Ya and Yb directions) at the time of an inserting operation of the flexible cable 20.

Here, structures of the connector 40 and the connector side guide part 70 are discussed with reference to FIG. 3A and FIG. 3B.

Figure 3A:
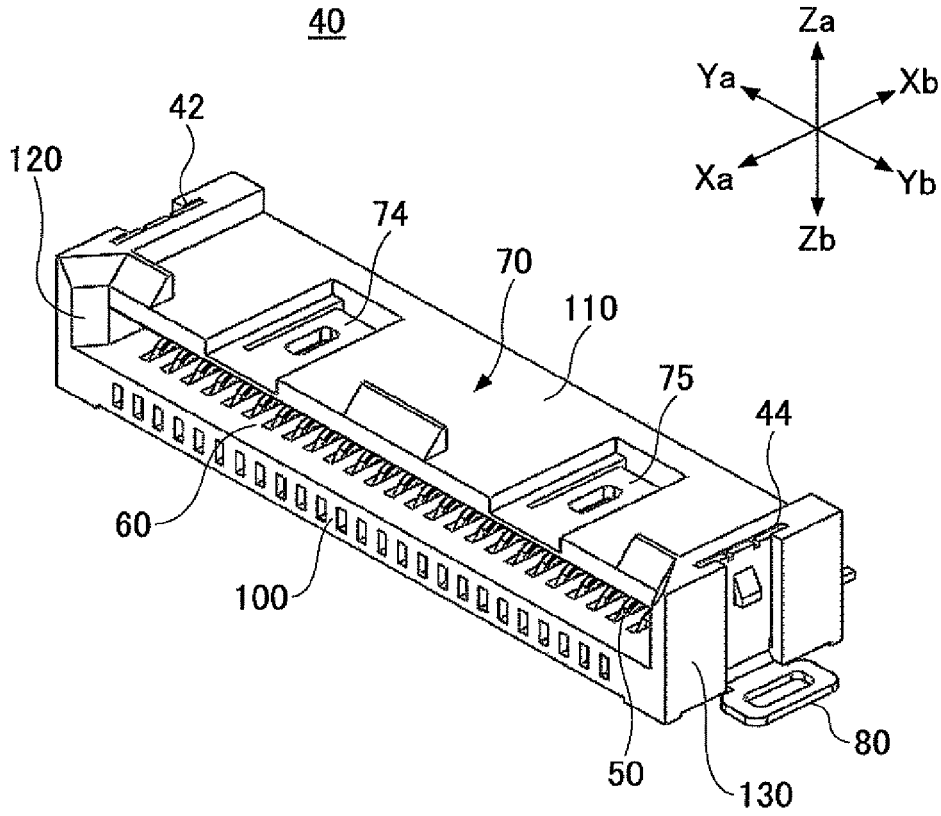
FIG. 3A is a perspective view of a connector of the first embodiment of the present invention.

FIG. 3A is a perspective view of the connector 40 of the first embodiment of the present invention. FIG. 3B is a perspective view of the connector side guide part 70 of the first embodiment of the present invention.

Figure 3B:
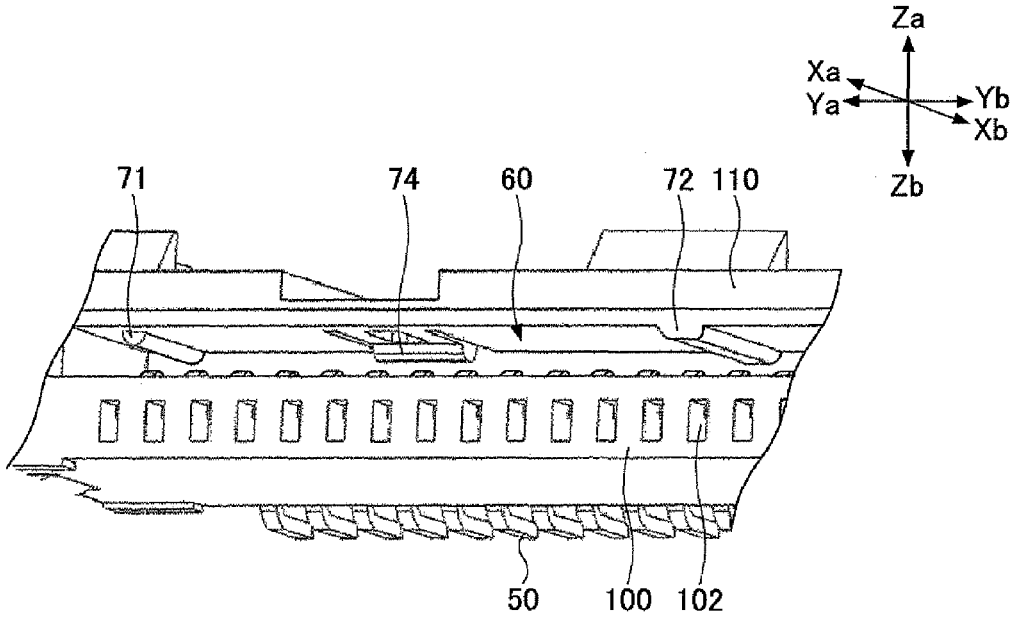
FIG. 3B is a perspective view of a connector side guide part of the first embodiment of the present invention.

Referring to FIG. 3A and FIG. 3B, the connector 40 includes the cable inserting opening 60, a lower part base 100, a ceiling plate 110, and side walls 120 and 130. The terminal part 30 and the cable side guide part 90 of the flexible cable 20 (see FIG. 1) are inserted in the cable inserting opening 60. The lower part base 100 includes the plural connector pins 50 provided at a lower side of the cable inserting opening 60.

The ceiling plate 110 includes the connector side guide part 70 provided at an upper side of the cable inserting opening 60. The side walls 120 and 130 are situated at left and right sides of the cable inserting opening 60.

The cable inserting opening 60 is a space surrounded by the lower part base 100, the ceiling plate 110, and the side walls 120 and 130. The thickness and width of the cable inserting opening 60 are slightly greater than the thickness and width of the terminal part 30 and the cable side guide part 90 of the flexible cable 20.

As shown in FIG. 3B, plural pin inserting holes 102 are formed, in the cable inserting and detaching directions (Xa and Xb directions), at the lower part base 100. The lower part base 100 is provided at a lower side of the cable inserting opening 60. The pin inserting holes 102 are configured to receive the plural connector pins 50. The plural pin inserting holes 102 are arranged in the left and right directions (Ya and Yb directions) with the same pitch so as to face the conductive patterns 32 ($32_1$~$32_n$) of the flexible cable 20.

Accordingly, the connector pins 50 inserted in the pin inserting holes 102 come in contact with the corresponding conductive patterns ($32_1$~$32_n$) and the conductive patterns 32 ($32_1$~$32_n$) are sandwiched by a spring force due to elastic deformation corresponding to the thickness of the cable side guide part 90.

The connector side guide part 70 is formed at a lower side of the ceiling plate 110 of the cable inserting opening 60. The connector side guide part 70 is configured to guide inserting and detaching operations of the cable side guide part 90.

The connector side guide part 70 includes guide projecting parts (restricting parts) 71 through 73 and a pair of engaging parts 74 and 75. The guide projecting parts (restricting parts) 71 through 73 are configured to prevent oblique inserting operations of the cable side guide part 90. The engaging parts 74 and 75 make the cable side guide part 90 become engaged at an inserting completion position. Each of the guide projecting parts 71 through 73 extends in a direction in parallel with the cable inserting and detaching directions (Xa and Xb directions). The guide projecting parts 71 through 73 are arranged side by side in the left and right directions (Ya and Yb directions) with the substantially same gap as that of the guide grooves 91 through 93 of the cable side guide part 90 so as to be engaged with the corresponding guide projecting parts 91 through 93.

The guide projecting parts 71 and 73 situated at corresponding sides of the connector side guide part 70 have semicircular-shaped configurations seen from a front side of the cable inserting opening 60. The guide projecting part 72 situated in the center of the connector side guide part 70 has a trapezoidal-shaped configuration seen from a front side of the cable inserting opening 60.

The engaging parts 74 and 75 are formed in a manner of a cantilever extending in the cable inserting and detaching directions (Xa and Xb directions). The head end parts of cantilever arm parts are deformed in the upper and lower directions (Za and Zb directions) so as to be engaged with the corresponding engaging holes 94 and 95 of the cable side guide part 90. The engaging parts 74 and 75 are arranged side by side in the left and right directions (Ya and Yb directions) in positions separated from each other with the same gap as that of the engaging holes 94 and 95.

Here, inserting operations where the terminal part 30 and the cable side guide part 90 of the flexible cable 20 are inserted in the cable inserting opening 60 are discussed, with reference to FIG. 4 and FIG. 5A through FIG. 5C.

Figure 4:
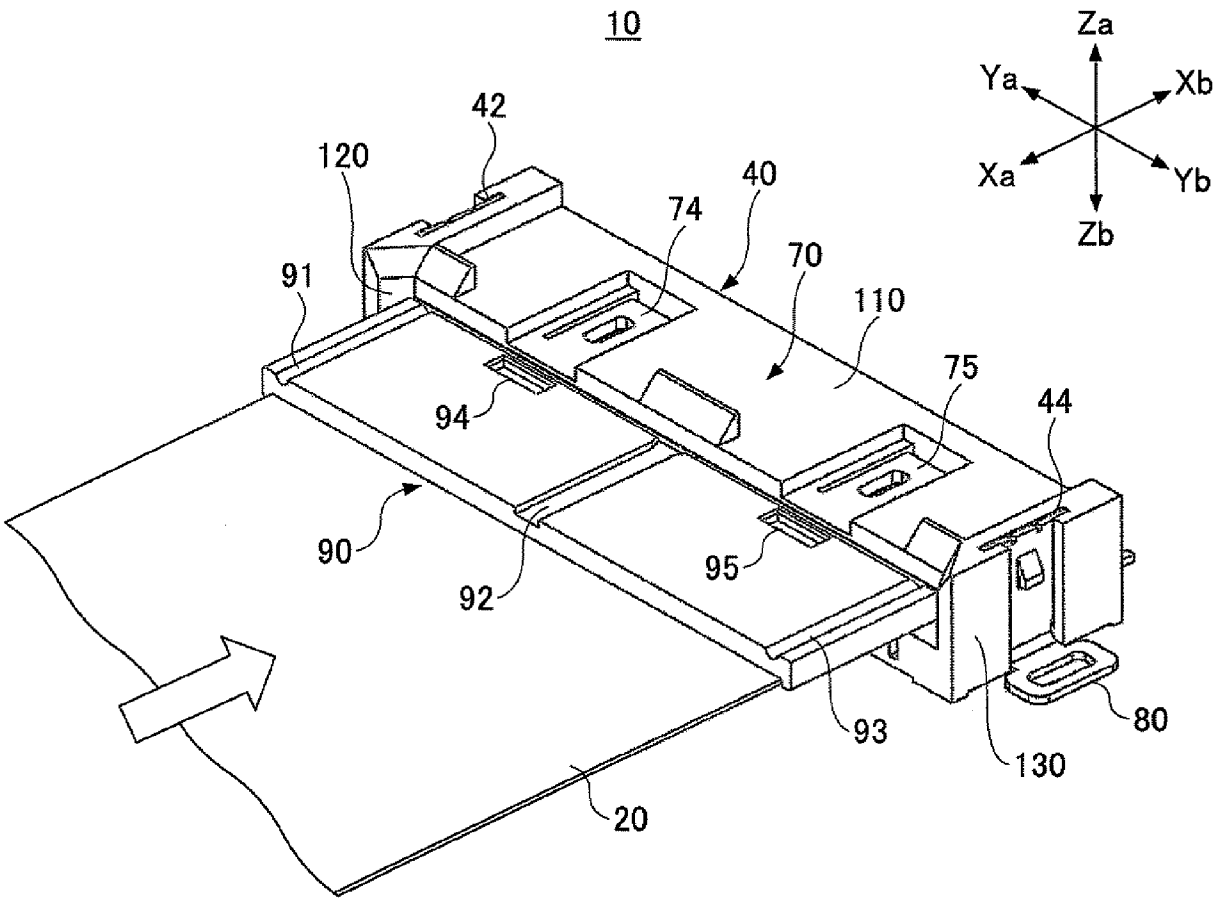
FIG. 4 is a perspective view showing a state before a cable side guide part is inserted in a cable inserting opening of the connector of the first embodiment of the present invention.
Figure 5A:
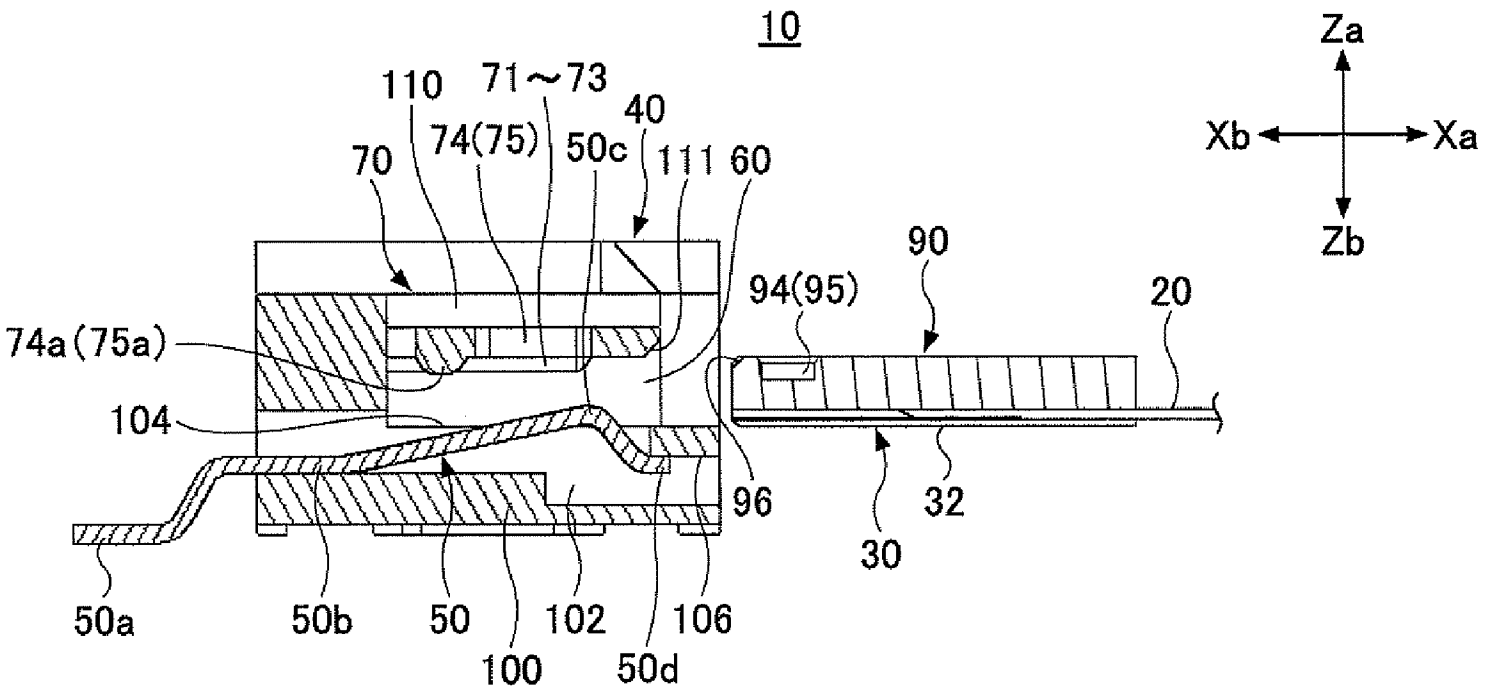
FIG. 5A is a cross-sectional view showing the state before the cable side guide part is inserted in the cable inserting opening of the connector of the first embodiment of the present invention.

FIG. 4 is a perspective view showing a state before the cable side guide part 90 is inserted in the cable inserting opening 60 of the connector 40 of the first embodiment of the present invention. FIG. 5A is a cross-sectional view showing the state before the cable side guide part 90 is inserted in the cable inserting opening 60 of the connector 40 of the first embodiment of the present invention.

As shown in FIG. 4 and FIG. 5A, when the flexible cable 20 is connected to the connector 40, the cable side guide part 90 is grasped and inserted into the cable inserting opening 60, so that the conductive patterns 32 ($32_1$~$32_n$) of the terminal part 30 come in contact with the corresponding connector pins 50 provided at a lower side of the connector 40.

In the cable side guide part 90, the engaging holes (engaged parts) 94 and 95 are arranged at an upper surface side. The engaging holes 94 and 95 are situated in positions facing arm head end parts 74*a* and 75*a* of the engaging parts 74 and 75 provided at the ceiling plate 110. In addition, the end part of the ceiling plate 110 is positioned inside toward the Xb direction, compared to a position of the lower part base 100. Therefore, as discussed below, the cable side guide part 90 can be obliquely inserted in the cable inserting opening 60 from an upper side. Furthermore, chamfers 96 and 111 are formed at an upper side corner part of a head end part of the cable side guide part 90 and a lower side corner part of an end part of the ceiling plate 110, respectively.

In addition, the lower part base 100 of the connector 40 includes the plural pin inserting holes 102 configured to pierce in the cable inserting and detaching directions (Xa and Xb directions). An opening 104 is formed at the upper side of each of the pin inserting holes 102. The openings 104 are in communication with the cable inserting opening 60. Each of the connector pins 50 received in the pin inserting holes 102 includes a terminal part 50*a*, an inserting part 50*b*, a contact part 50*c*, and a latch part 50*d*. The terminal 50*a* of the connector pin 50 is provided so as to extend to a rear surface of the connector 40 and is soldered to a conductive pattern on the printed wiring board. In addition, the inserting part 50*b* is inserted from the rear side (Xb side) of the connector 40 into the pin inserting hole 102.

The contact part 50*c* of the connector pin 50 is formed so as to angle obliquely upward from the inserting part 50*b*. An upper part of a portion which is inclined projects into the cable inserting opening 60 via the opening 104 of the pin inserting hole 102. The latch part 50*d* of the connector pin 50 is bent in an S-shaped manner at the head end of the contact part 50*c*. The latch part 50*d* is latched with a horizontal part 106 of the pin inserting hole 102 so that upward movement of the connector pin 50 is restricted.

Figure 5B:
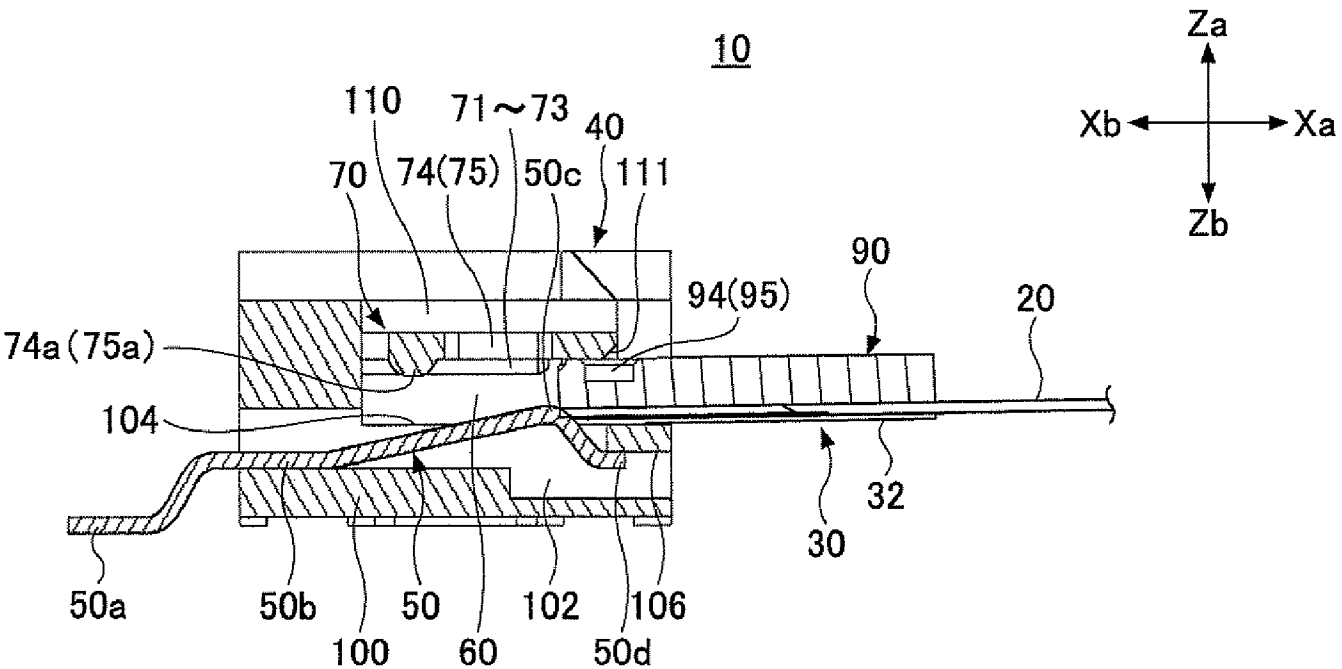
FIG. 5B is a cross-sectional view showing a state where a head end of the cable side guide part is inserted in the cable inserting opening of the connector of the first embodiment of the present invention.

FIG. 5B is a cross-sectional view showing a state where a head end of the cable side guide part 90 is inserted in the cable inserting opening 60 of the connector 40 of the first embodiment of the present invention. As shown in FIG. 5B, during a process in which the cable side guide part 90 is inserted in the cable inserting opening 60 of the connector 40, the guide projecting parts 71 through 73 configured to project into the cable inserting opening 60 of the connector 40 are respectively engaged with the guide grooves 91 through 93 of the cable side guide part 90. As a result of this, the inserting position of the cable side guide part 90 in the left and right directions (Ya and Yb directions) is restricted by the guide projecting parts 71 through 73 so as to be guided in the cable inserting and detaching directions (Xa and Xb directions).

By this guiding operation, the plural conductive patterns 32 of the terminal part 30 are positioned to come in contact with the contact parts 50*c* of the corresponding plural connector pins 50. Therefore, by engagement of the guide projecting parts 71 through 73 and the guide grooves 91 through 93, inserting positions of the conductive patterns 32 and of the corresponding connector pins 50 are consistent with each other.

When the cable side guide part 90 is inserted in the cable inserting opening 60 of the connector 40, the conductive patterns 32 of the terminal part 30 at a lower surface come in contact with the contact parts 50*c* of the connector pins 50, and the upper surface of the cable side guide part 90 is pushed to the lower surface of the ceiling plate 110 of the connector 40 and is sandwiched in the upper and lower directions (Za and Zb directions).

Figure 5C:
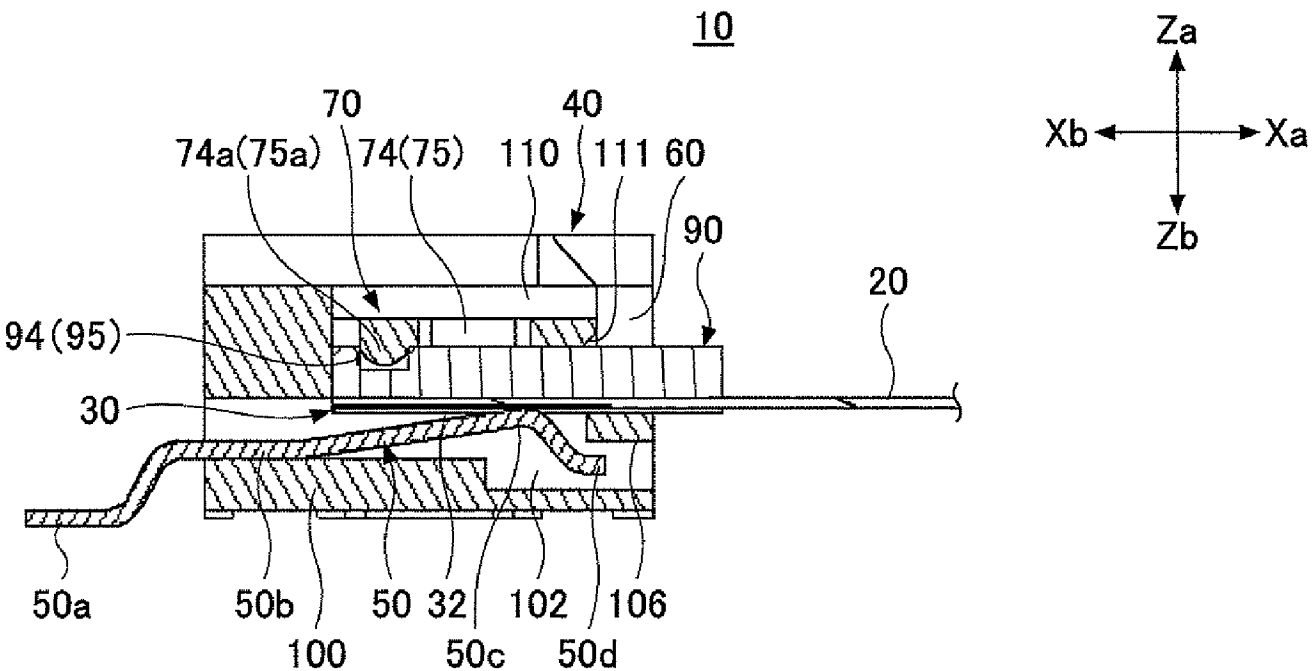
FIG. 5C is a cross-sectional view showing an engaging state where the cable side guide part is inserted in and engaged with the cable inserting opening of the connector of the first embodiment of the present invention.

FIG. 5C is a cross-sectional view showing an engaging state where the cable side guide part 90 is inserted in and engaged with the cable inserting opening 60 of the connector 40 of the first embodiment of the present invention.

As shown in FIG. 5C, by further sliding the cable side guide part 90 in the inserting direction (Xb direction), while the upper surface of the head end of the cable side guide part 90 slides and comes in contact with the arm head end parts 74*a* and 75*a* of the engaging parts 74 and 75, the upper surface of the head end of the cable side guide part 90 is deformed downward so as to push down the contact part 50*c*. As a result of this, the contact pressure of the connector pin 50 to the conductive pattern 32 is increased, so that an electrical connection between the connector pin 50 and the conductive pattern 32 is securely made.

When the cable side guide part 90 further slides in the inserting direction (Xb direction), the arm head end parts 74*a* and 75*a* of the engaging parts 74 and 75 slide and come in contact with the upper surface of the head end of the cable side guide part 90 and are deformed upward. In addition, the contact parts 50*c* of the connector pins 50 are elastically deformed downward.

In addition, when the cable side guide part 90 reaches the inserting completion position of the cable inserting opening 60, the arm head end parts 74*a* and 75*a* of the engaging parts 74 and 75 are engaged with the engaging holes 94 and 95 of the cable side guide part 90 and the terminal part 30 is sandwiched by the contact pressure of the connector pins 50. When the head end parts 74*a* and 75*a* of the engaging parts 74 and 75 are engaged with the engaging holes 94 and 95 of the cable side guide part 90, a click operation is transferred, as a click feeling, to an operator who grasps the cable side guide part 90, and as a click sound to ears of the operator.

Accordingly, the operator can confirm that, as a feeling, via the above-mentioned click operation, the cable side guide part 90 is inserted in the cable inserting opening 60 of the connector 40 and it is held that the conductive patterns 32 of the terminal part 30 come in contact with the contact parts 50*c* of the connector pins 50.

After the inserting of the cable side guide part 90 is completed, in the cable inserting opening 60, the head end parts 74*a* and 75*a* of the engaging parts 74 and 75 are engaged with the engaging holes 94 and 95 of the cable side guide part 90, and the terminal part 30 is sandwiched by the contact pressure of the connector pins 50. Hence, even if the flexible cable 20 is pulled in the detaching direction (Xa direction), it is possible to prevent the flexible cable 20 from being easily taken out. When the flexible cable 20 is separated from the connector 40, by pulling the cable side guide part 90 in the detaching direction (Xa direction), the head end parts 74*a* and 75*a* of the engaging parts 74 and 75 are detached from the engaging holes 94 and 95 of the cable side guide part 90 so that the flexible cable 20 can be separated from the connector 40.

Here, an inserting operation when the cable side guide part 90 is inserted obliquely from an upper side into the cable inserting opening 60 of the connector 40 is discussed.

Figure 6:
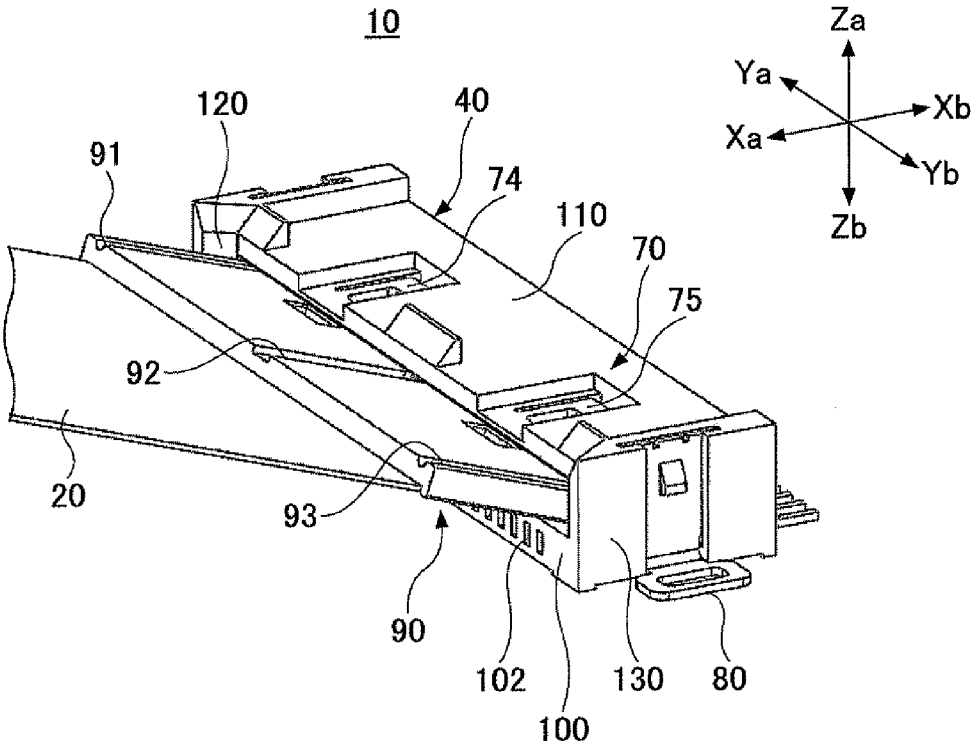
FIG. 6 is a perspective view showing a state where the cable side guide part is inserted obliquely from an upper side into the cable inserting opening of the connector of the first embodiment of the present invention.
Figure 7A:
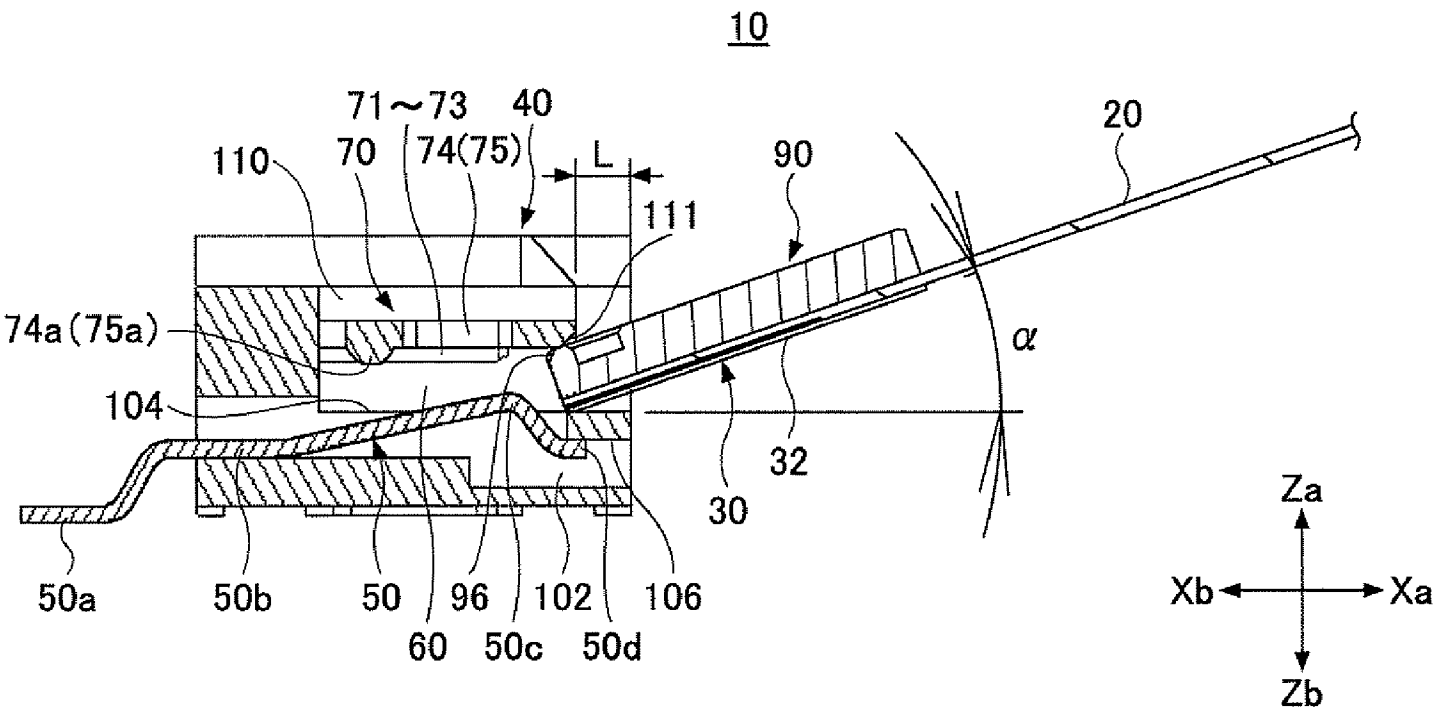
FIG. 7A is a cross-sectional view showing the state before the cable side guide part is inserted obliquely from the upper side into the cable inserting opening of the connector of the first embodiment of the present invention.
Figure 7B:
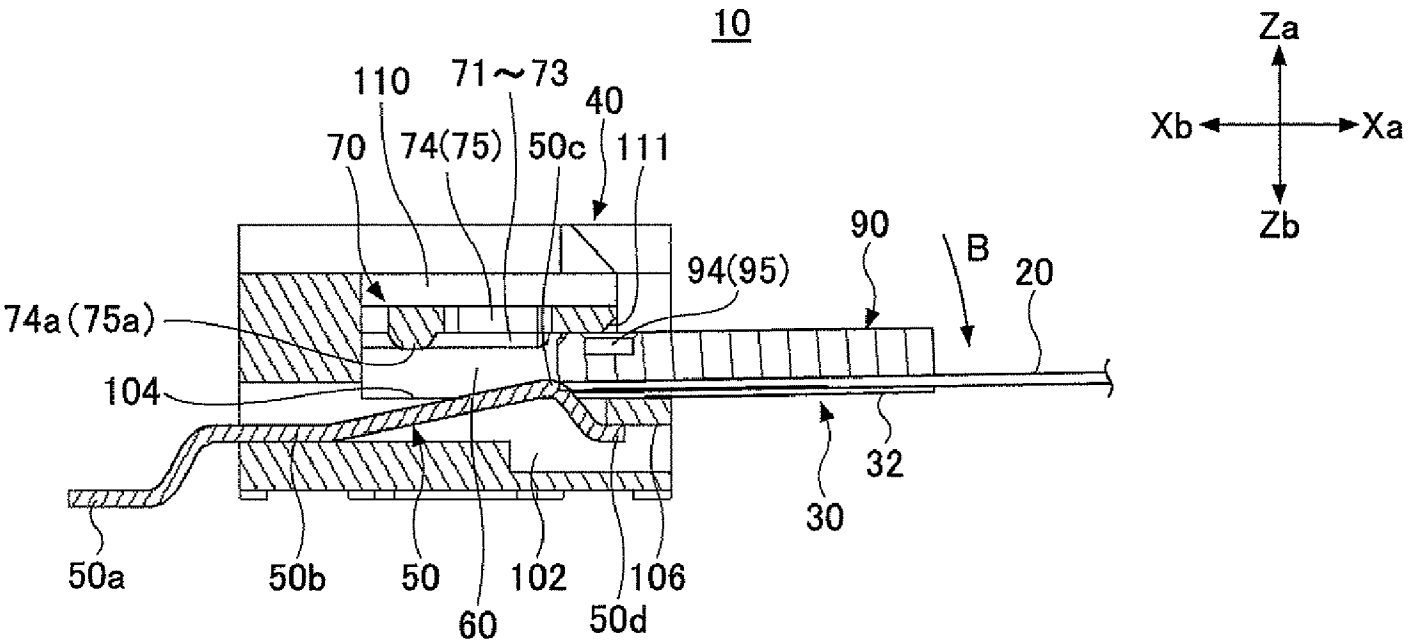
FIG. 7B is a cross-sectional view showing a state where a head end of the cable side guide part is being inserted obliquely from an upper side into the cable inserting opening of the connector of the first embodiment of the present invention.

FIG. 6 is a perspective view showing a state where the cable side guide part 90 is inserted obliquely from an upper side into the cable inserting opening 60 of the connector 40 of the first embodiment of the present invention. FIG. 7A is a cross-sectional view showing the state before the cable side guide part 90 is inserted obliquely from the upper side into the cable inserting opening 60 of the connector 40 of the first embodiment of the present invention.

As shown in FIG. 6 and FIG. 7A, in the connector 40, at the entrance of the cable inserting opening 60, the end part of the ceiling plate 110 is situated inside (toward Xb side) by a length L, compared to the end part of the lower part base 100. Because of this, the connector 40 can be inserted in the cable inserting opening 60 so that the cable side guide part 90 is inserted obliquely from an upper side into the cable inserting opening 60 having an inclination angle α with the horizontal direction.

In other words, in a case where the cable side guide part 90 is inserted obliquely from an upper side into the cable inserting opening 60 having an inclination angle α with the horizontal direction, while the upper surface of the cable side guide part 90 slides and comes in contact with the end part of the ceiling plate 110, the head end part of the cable side guide part 90 slides on the upper surface of the lower part base 100.

FIG. 78 is a cross-sectional view showing an inserting state where the cable side guide part 90 is inserted in and horizontally guided in the cable inserting opening 60 of the connector 40 of the first embodiment of the present invention. As shown in FIG. 78, the chamfers 96 and 111 are formed at an upper side corner part of a head end part of the cable side guide part 90 and a lower side corner part of an end part of the ceiling plate 110, respectively. Accordingly, while the cable side guide part 90 slides on the upper surface of the lower part base 100, the cable side guide part 90 enters into the cable inserting opening 60. In addition, the cable side guide part 90 is guided so as to be rotated in a B direction and the inclination angle is changed so that a horizontal state (α=0) is formed.

In a process where the cable side guide part 90 is inserted in the cable inserting opening 60, the guide projecting parts 71 through 73 projecting in the cable inserting opening 60 of the connector 40 are respectively engaged with the guide grooves 91 through 93 of the cable side guide part 90. As a result of this, the inserting position of the cable side guide part 90 in the left and right directions (Ya and Yb directions) is restricted by the guide projecting parts 71 through 73 so that the cable side guide part 90 is guided in the cable inserting and detaching directions (Xa and Xb directions).

By this guiding operation, the plural conductive patterns 32 of the terminal part 30 are positioned where the conductive patterns 32 come in contact with the corresponding contact parts 50*c* of plural connector pins 50. Therefore, the inserting positions of the conductive patterns 32 and the positions of the corresponding connector pins 50 are consistent with each other due to engagement of the guide projecting parts 71 through 73 and the guide grooves 91 through 93.

Figure 7C:
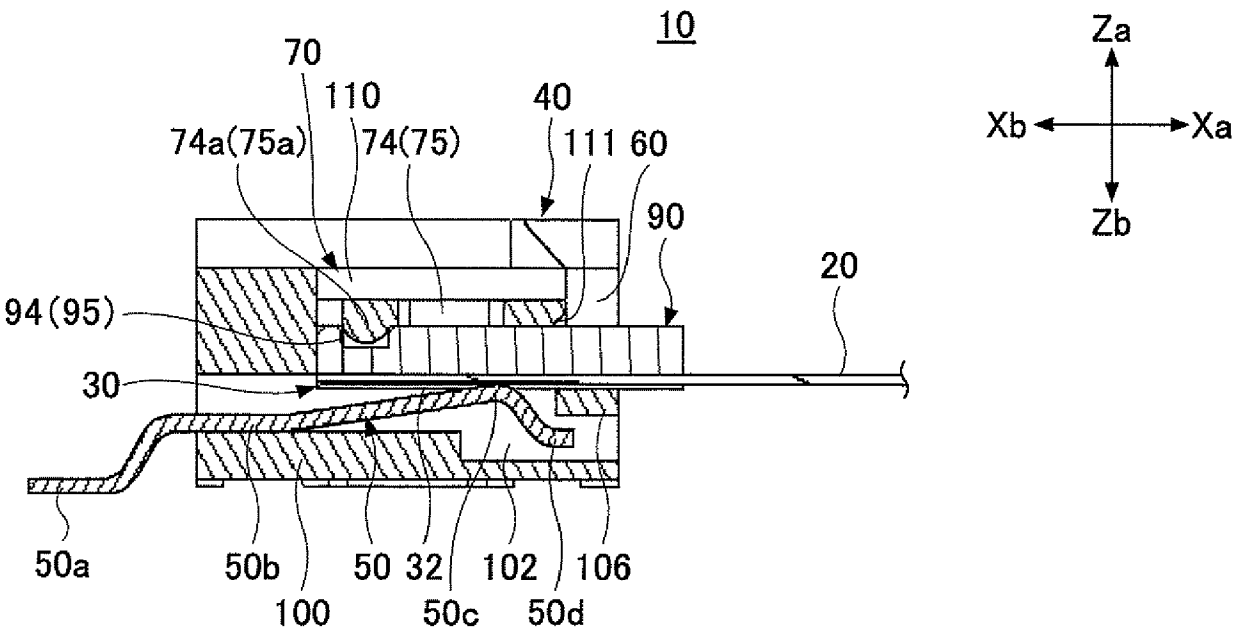
FIG. 7C is a cross-sectional view showing an engaging state where the cable side guide part is inserted obliquely from an upper side into and engaged with the cable inserting opening of the connector of the first embodiment of the present invention.

FIG. 7*c* is a cross-sectional view showing an engaging state where the cable side guide part 90 is inserted and engaged with the cable inserting opening 60 of the connector 40 of the first embodiment of the present invention. As shown in FIG. 7C, by further sliding the cable side guide part 90 in the inserting direction (Xb direction), while the head end of the cable side guide part 90 slides and comes in contact with the arm head end parts 74*a* and 75*a* of the engaging parts 74 and 75, the head end of the cable side guide part 90 is deformed downward so as to push down the contact parts 50*c*. As a result of this, the contact pressure of the connector pins 50 on the conductive patterns 32 is increased, so that an electrical connection between the connector pins 50 and the conductive patterns 32 is securely made.

When the cable side guide part 90 further slides in the inserting direction (Xb direction), the arm head end parts 74*a* and 75*a* of the engaging parts 74 and 75 slide and come in contact with the upper surface of the head end of the cable side guide part 90 and are deformed upward. In addition, the contact parts 50*c* of the connector pins 50 are elastically deformed downward.

In addition, when the cable side guide part 90 reaches the inserting completion position of the cable inserting opening 60, the arm head end parts 74*a* and 75*a* of the engaging parts 74 and 75 are engaged with the engaging holes 94 and 95 of the cable side guide part 90 and the terminal part 30 is sandwiched by the contact pressure of each of the connector pins 50.

A click operation when the head end parts 74*a* and 75*a* of the engaging parts 74 and 75 are engaged with the engaging holes 94 and 95 of the cable side guide part 90 is transferred, as a click feeling, to an operator who grasps the cable side guide part 90, and as a click sound to the ears of the operator.

Thus, according to the flexible cable connecting structure 10, even if the cable side guide part 90 is inserted obliquely from an upper side into the cable inserting opening 60 having an inclination angle α with the horizontal direction, it is possible to guide the cable side guide part 90 so that the cable side guide part 90 is in a horizontal state. As well as a case where the cable side guide part 90 is horizontally inserted, it is possible to insert the cable side guide part 90 into the cable inserting opening in a straight manner.

[Second Embodiment]

Figure 8:
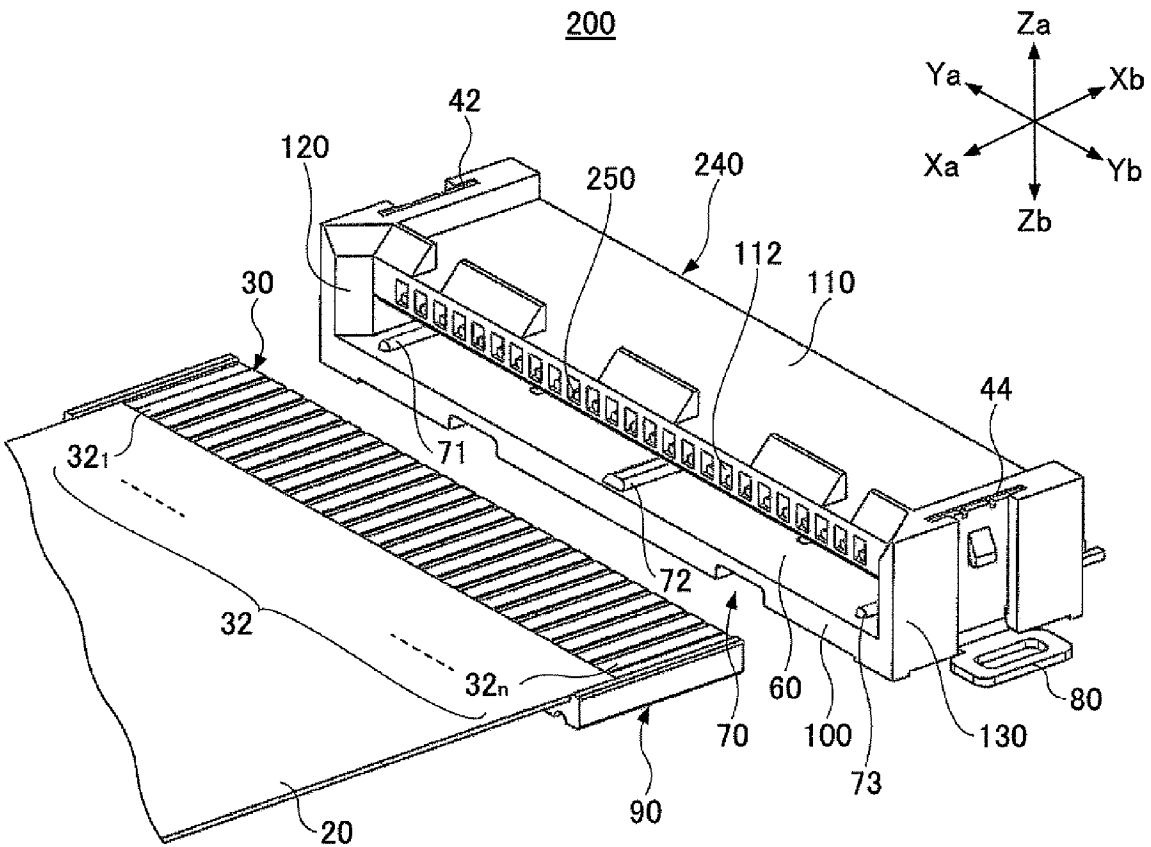
FIG. 8 is an exploded and perspective view of a flexible cable connecting structure of a second embodiment of the present invention.

FIG. 8 is an exploded perspective view of a flexible cable connecting structure of a second embodiment of the present invention. In FIG. 8, parts that are the same as the parts discussed in the first embodiment of the present invention are given the same reference numerals, and explanation thereof is omitted.

As shown in FIG. 8, in a flexible cable connecting structure 200 of the second embodiment of the present invention, by inserting the terminal part 30 formed at the end part of the flexible cable 20 into the cable inserting opening 60 of the connector 40, plural connector pins 250 arranged side by side at an upper side of the cable inserting opening 60 are connected to the terminal part 30. The flexible cable 20 in the second embodiment of the present invention has the same structure as that of the first embodiment. Hence, parts that are the same as the parts discussed in the first embodiment of the present invention are given the same reference numerals, and explanation thereof is omitted.

A connector 240 of the second embodiment of the present invention is a top contact type connector where plural of the connector pins 250 are arranged side by side at an upper side of the cable inserting opening 60 and the connector side guide part 70 is provided at a lower side of the cable inserting opening 60.

Accordingly, the flexible cable 20 is inserted in the cable inserting opening 60 in a state which is reverse of the state of the first embodiment, where upper and lower parts are reversed. That is to say, the conductive patterns 32 ($\mathbf{32}_1$~$32_n$) of the terminal part 30 are situated at an upper surface and the cable side guide part 90 is at a lower surface.

Figure 9:
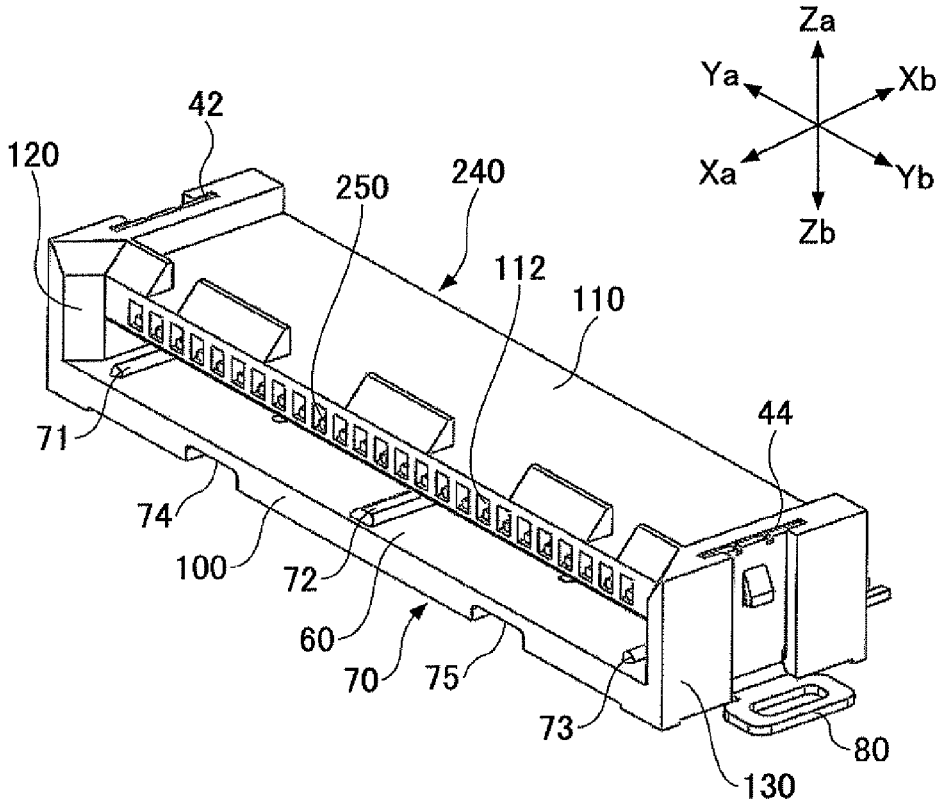
FIG. 9 is a perspective view of a connector of the second embodiment of the present invention.

FIG. 9 is a perspective view of the connector 240 of the second embodiment of the present invention.

Referring to FIG. 9, the connector 240 includes the cable inserting opening 60, the lower part base 100, the ceiling plate 110, and the side walls 120 and 130. The terminal part 30 and the cable side guide part 90 of the flexible cable 20 are inserted in the cable inserting opening 60. The ceiling plate 110 includes plural connector pins 250 provided at an upper side of the cable inserting opening 60.

The lower part base 100 includes the connector side guide part 70 provided at a lower side of the cable inserting opening 60. The side walls 120 and 130 are situated at left and right sides of the cable inserting opening 60.

Plural pin inserting holes 112 are formed, in the cable inserting and detaching directions (Xa and Xb directions), at the ceiling plate 110 provided at the upper side of the cable inserting opening 60. The pin inserting holes 112 are configured to receive the plural connector pins 250. The plural pin inserting holes 112 are arranged in the left and right directions (Ya and Yb directions) with the same pitch so as to face the conductive patterns 32 ($32_1$~$32_n$) of the flexible cable 20.

Accordingly, the connector pins 250 inserted in the pin inserting holes 112 come in contact with the corresponding conductive patterns ($32_1$~$32_n$) of the flexible cable 20.

The connector side guide part 70 is formed at the upper surface of the lower base part 100.

The connector side guide part 70 includes the guide projecting parts (restricting parts) 71 through 73 and the pair of engaging parts 74 and 75.

Here, inserting operations where the terminal part 30 and the cable side guide part 90 of the flexible cable 20 are inserted in the cable inserting opening 60 are discussed.

Figure 10A:
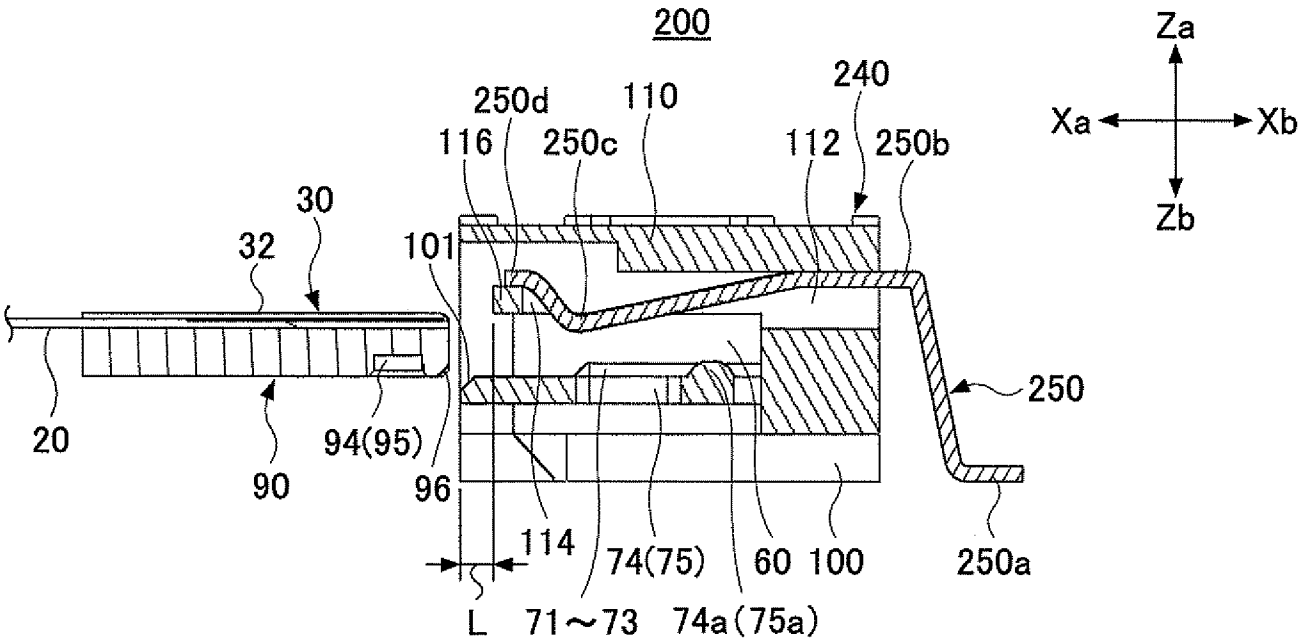
FIG. 10A is a cross-sectional view showing the state before the cable side guide part is inserted in the cable inserting opening of the connector of the second embodiment of the present invention.

FIG. 10A is a cross-sectional view showing the state before the cable side guide part 90 is inserted in the cable inserting opening 60 of the connector 240 of the second embodiment of the present invention.

As shown in FIG. 10A, when the flexible cable 20 is connected to the connector 240, the cable side guide part 90 is grasped and inserted into the cable inserting opening 60 of the connector 240 in a state where the conductive patterns 32 are at an upper side, so that the conductive patterns 32 ($32_1$~$32_n$) of the terminal part 30 come in contact with the corresponding connector pins 250 provided at an upper side of the connector 240.

In the cable side guide part 90, the engaging holes (engaged parts) 94 and 95 are arranged at a lower surface. The engaging holes 94 and 95 are situated in positions facing the arm head end parts 74*a* and 75*a* of the engaging parts 74 and 75 provided at the upper surface of the lower part base 100. In addition, the chamfers 96 and 111 are formed at a lower side corner part of a head end part of the cable side guide part 90 and an upper side corner part of an end part of the lower part base 100, respectively.

In addition, the ceiling plate 110 of the connector 240 includes the plural pin inserting holes 112 configured to pierce in the cable inserting and detaching directions (Xa and Xb directions). An opening 114 is formed at the lower side of each of the pin inserting holes 112. Each of the connector pins 250 received in the pin inserting holes 112 includes a terminal part 250*a*, an inserting part 250*b*, a contact part 250*c*, and a latch part 250*d*.

The terminal 250*a* of the connector pin 250 is provided so as to be bent downward from the rear surface side of the connector 240 and is soldered to a conductive pattern on the printed wiring board. In addition, the inserting part 250*b* is inserted from the rear side (Xb side) of the connector 240 into the pin inserting hole 112.

The contact part 250*c* of the connector pin 250 is formed so as to angle obliquely downward from the inserting part 250*b*. A lower part of a portion which inclines projects into the cable inserting opening 60 via the opening 114 of the pin inserting hole 112. The latch part 250*d* of the connector pin 250 is bent in an S-shaped manner at head end of the contact part 250*c*. The latch part 250*d* is latched with a horizontal part 116 of the pin inserting hole 112 so that downward movement of the connector pin 250 is restricted. The horizontal part 116 is provided at the upper part of the entrance of the cable inserting opening 60. The end part of the entrance side of the horizontal part 116 is situated inside (toward Xb side) by a length L, compared with the end part of the lower part base 100. Because of this, as discussed below, the cable side guide part 90 can be inserted obliquely from an upper side into the cable inserting opening 60.

Figure 10B:
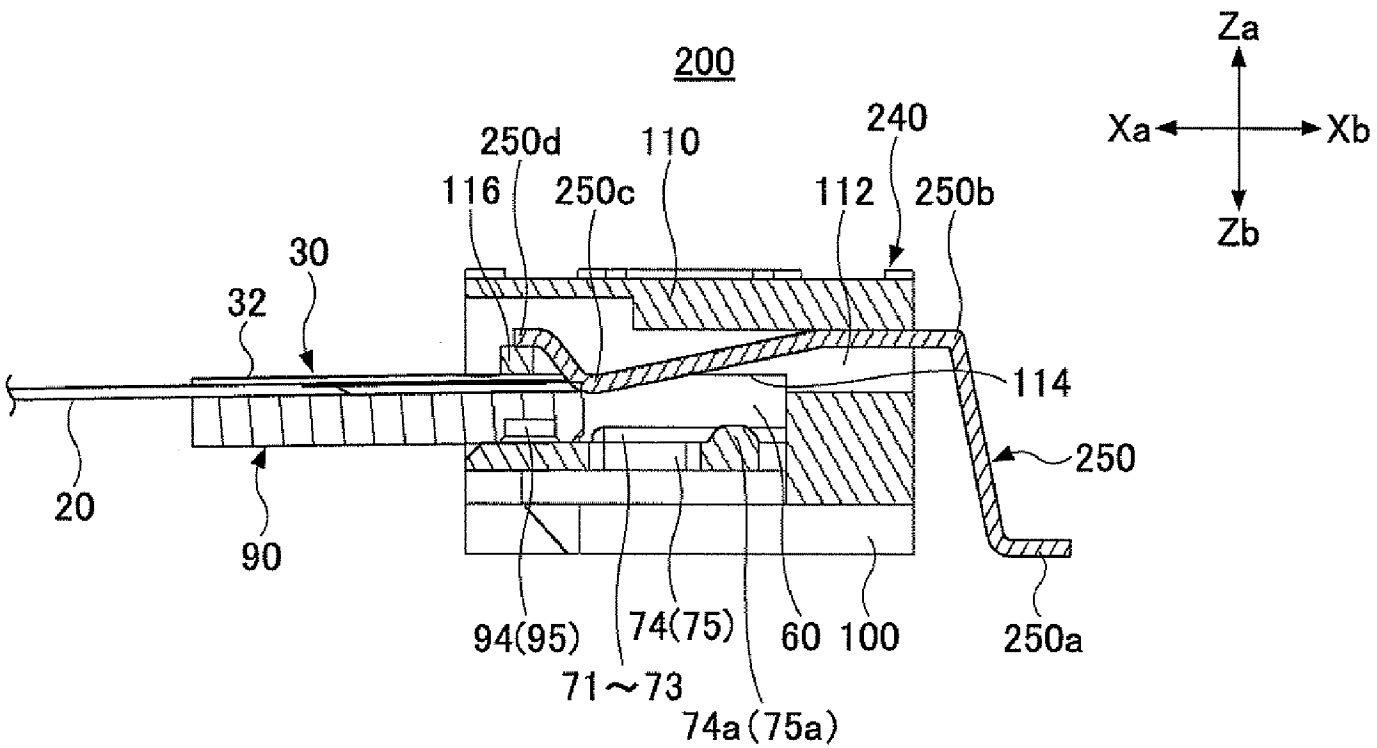
FIG. 10B is a cross-sectional view showing a state where a head end of the cable side guide part is inserted in the cable inserting opening of the connector of the second embodiment of the present invention.

FIG. 10B is a cross-sectional view showing a state where a head end of the cable side guide part 90 is inserted in the cable inserting opening 60 of the connector 240 of the second embodiment of the present invention.

As shown in FIG. 10B, during a process in which the cable side guide part 90 is inserted in the cable inserting opening 60 of the connector 240, the guide projecting parts 71 through 73 configured to project into the cable inserting opening 60 of the connector 240 are respectively engaged with the guide grooves 91 through 93 of the cable side guide part 90. As a result of this, the inserting position of the cable side guide part 90 in the left and right directions (Ya and Yb directions) is restricted by the guide projecting parts 71 through 73 so as to be guided in the cable inserting and detaching directions (Xa and Xb directions).

By this guiding operation, the plural conductive patterns 32 of the terminal part 30 are positioned to come in contact with the contact parts 250*c* of the corresponding plural connector pins 250. Therefore, by engagement of the guide projecting parts 71 through 73 and the guide grooves 91 through 93, an inserting position of the conductive patterns 32 and the connector pins 250 are consistent with each other.

When the cable side guide part 90 is inserted in the cable inserting opening 60 of the connector 240, the conductive patterns 32 of the terminal part 30 at an upper surface come in contact with the contact parts 250*c* of the connector pins 250, and the lower surface of the cable side guide part 90 is pushed onto the upper surface of the lower part base 100 of the connector 240 and is sandwiched in the upper and lower directions (Za and Zb directions).

Figure 10C:
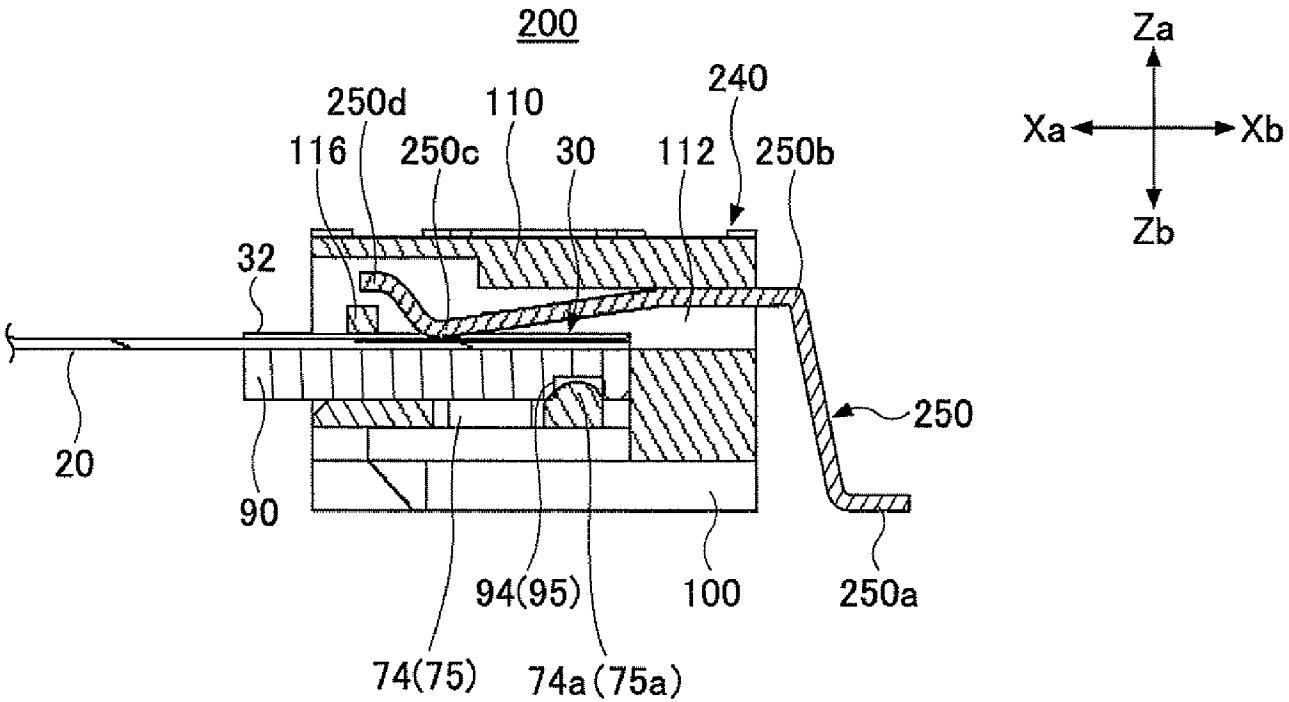
FIG. 10C is a cross-sectional view showing an engaging state where the cable side guide part is inserted into and engaged with the cable inserting opening of the connector of the second embodiment of the present invention.

FIG. 10C is a cross-sectional view showing an engaging state where the cable side guide part 90 is inserted in and engaged with the cable inserting opening 60 of the connector 240 of the second embodiment of the present invention.

As shown in FIG. 10C, by further sliding the cable side guide part 90 in the inserting direction (Xb direction), while the lower surface of the head end of the cable side guide part 90 slides and comes in contact with the arm head end parts 74*a* and 75*a* of the engaging parts 74 and 75, the lower surface of the head end of the cable side guide part 90 is deformed upward so as to push up the contact parts 250*c* of the connector pins 250. As a result of this, the contact pressure of the connector pins 250 on the conductive patterns 32 is increased, so that electrical connection between the connector pins 250 and the conductive patterns 32 is securely made.

When the cable side guide part 90 further slides in the inserting direction (Xb direction), the arm head end parts 74*a* and 75*a* of the engaging parts 74 and 75 slide and come in contact with the lower surface of the head end of the cable side guide part 90 and are deformed downward. In addition, the contact parts 250*c* of the connector pins 50 are elastically deformed upward.

In addition, when the cable side guide part 90 reaches the inserting completion position of the cable inserting opening 60, the arm head end parts 74*a* and 75*a* of the engaging parts 74 and 75 are engaged with the engaging holes 94 and 95 of the cable side guide part 90 and the terminal part 30 is sandwiched by the contact pressure of the connector pins 250. A click operation when the head end parts 74*a* and 75*a* of the engaging parts 74 and 75 are engaged with the engaging holes 94 and 95 of the cable side guide part 90 is transferred, as a click feeling, to an operator who grasps the cable side guide part 90, and as a click sound to the ears of the operator.

Accordingly, the operator can confirm that, as a feeling, via the above-mentioned click operation, the cable side guide part 90 is inserted in the cable inserting opening 60 of the connector 240 and it is held that the conductive patterns 32 of the terminal part 30 come in contact with the contact parts 250*c* of the corresponding connector pins 250. When the flexible cable 20 is separated from the connector 240, by pulling the cable side guide part 90 in the detaching direction (Xa direction), the head end parts 74*a* and 75*a* of the engaging parts 74 and 75 are detached (removed) from the engaging holes 94 and 95 of the cable side guide part 90 so that the flexible cable 20 can be separated from the connector 240.

Here, an inserting operation when the cable side guide part 90 is inserted obliquely from an upper side to the cable inserting opening 60 of the connector 240 is discussed.

Figure 11A:
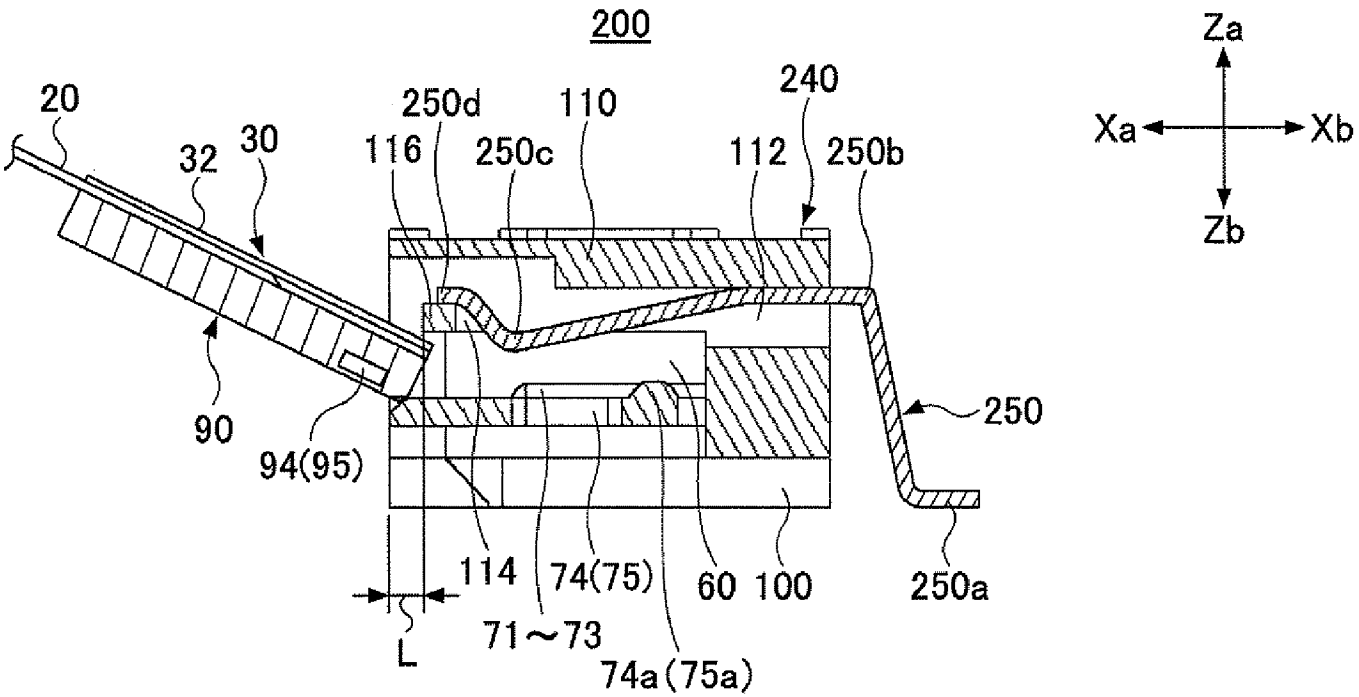
FIG. 11A is a cross-sectional view showing the state before the cable side guide part is inserted obliquely from the upper side into the cable inserting opening of the connector of the second embodiment of the present invention.

FIG. 11A is a cross-sectional view showing the state before the cable side guide part 90 is inserted obliquely from the upper side to the cable inserting opening 60 of the connector 240 of the second embodiment of the present invention.

As shown in FIG. 11A, in the connector 240, at the cable inserting opening 60, the entrance side of the end part of the horizontal part 116 at the entrance upper side is situated inside (toward Xb side) by a length L, compared to the end part of the lower part base 100. Because of this, the connector 40 can be inserted in the cable inserting opening 60 so that the cable side guide part 90 is inserted obliquely from an upper side into the cable inserting opening 60 having an inclination angle α with the horizontal direction.

In other words, in a case where the cable side guide part 90 is inserted obliquely from an upper side into the cable inserting opening 60 having an inclination angle α with the horizontal direction, while the connecting part 30 provided at the upper surface side of the cable side guide part 90 slides and comes in contact with the end part of the ceiling plate 110, the head end part of the cable side guide part 90 slides on the upper surface of the lower part base 100.

Figure 11B:
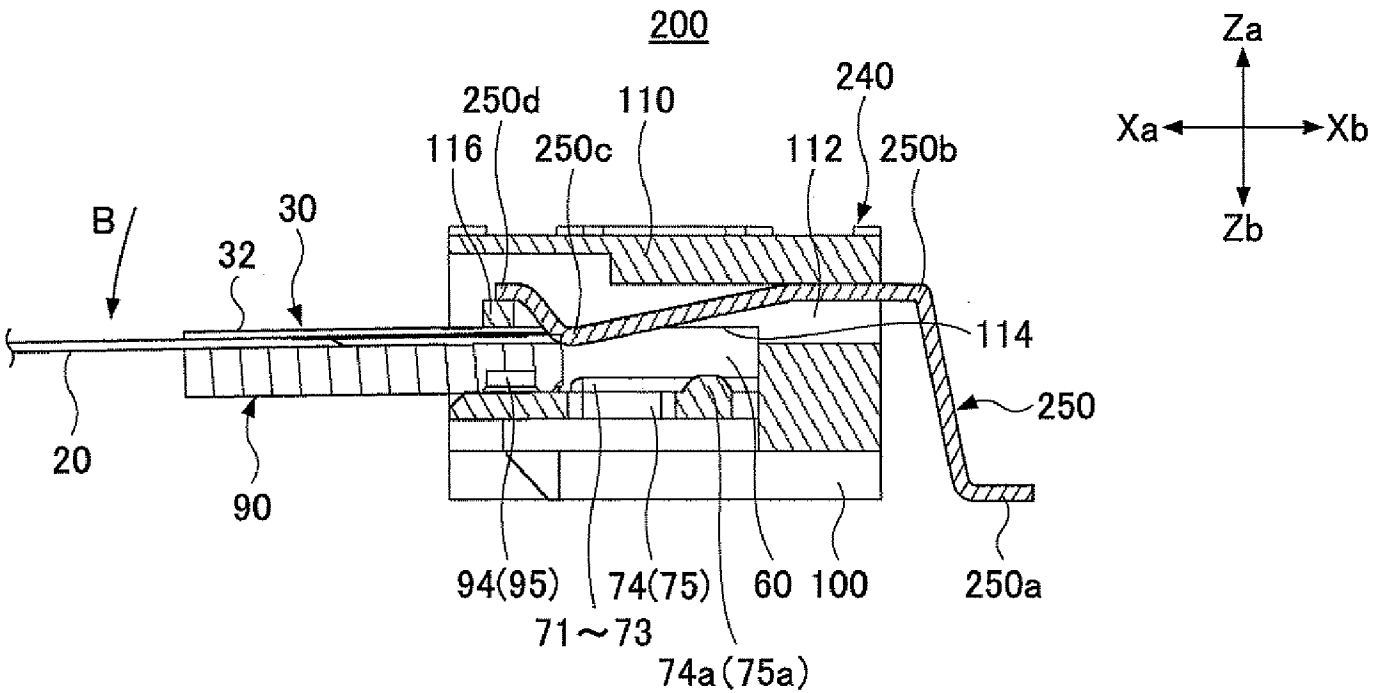
FIG. 11B is a cross-sectional view showing a state where a head end of the cable side guide part is being inserted obliquely from an upper side into the cable inserting opening of the connector of the second embodiment of the present invention.

FIG. 11B is a cross-sectional view showing a state where the cable side guide part 90 is being inserted and horizontally guided into the cable inserting opening 60 of the connector 240 of the second embodiment of the present invention.

As shown in FIG. 11B, the chamfers 96 and 111 are formed at a lower side corner part of a head end part of the cable side guide part 90 and an upper side corner part of an end part of the lower part base 100. Accordingly, while the cable side guide part 90 slides on the upper surface of the lower part base 100, the cable side guide part 90 enters into the cable inserting opening 60. In addition, the cable side guide part 90 is guided so as to be rotated in a B direction and the inclination angle is changed so that a horizontal state (α=0) is formed.

In a process where the cable side guide part 90 is inserted in the cable inserting opening 60, the guide projecting parts 71 through 73 projecting in the cable inserting opening 60 of the connector 40 are respectively engaged with the guide grooves 91 through 93 of the cable side guide part 90. As a result of this the inserting position of the cable side guide part 90 in the left and right directions (Ya and Yb directions) is restricted by the guide projecting parts 71 through 73 so that the cable side guide part 90 is guided in the cable inserting and detaching directions (Xa and Xb directions).

By this guiding operation, the plural conductive patterns 32 of the terminal part 30 are positioned to come in contact with the contact parts 250*c* of the corresponding plural connector pins 250. Therefore, the inserting positions of the conductive patterns 32 and the corresponding connector pins 250 are consistent with each other due to engagement of the guide projecting parts 71 through 73 and the guide grooves 91 through 93.

Figure 11C:
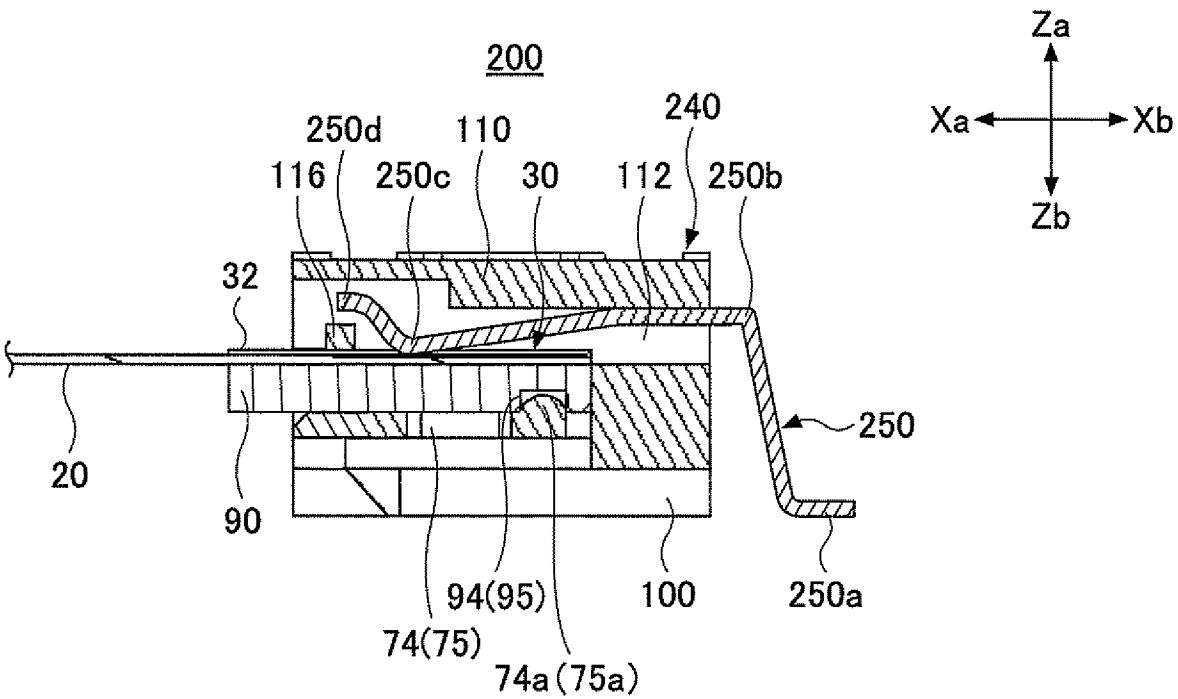
FIG. 11C is a cross-sectional view showing an engaging state where the cable side guide part is inserted obliquely from an upper side into and engaged with the cable inserting opening of the connector of the second embodiment of the present invention.

FIG. 11C is a cross-sectional view showing an engaging state where the cable side guide part 90 is inserted and engaged with the cable inserting opening 60 of the connector 240 of the second embodiment of the present invention.

As shown in FIG. 11C, by further sliding the cable side guide part 90 in the inserting direction (Xb direction), while the head end of the cable side guide part 90 slides and comes in contact with the arm head end parts 74*a* and 75*a* of the engaging parts 74 and 75, the head end of the cable side guide part 90 is deformed upward so as to push up the contact parts 250*c*. As a result of this, the contact pressure of the connector pins 250 on the conductive patterns 32 is increased, so that electrical connection between the connector pins 250 and the conductive patterns 32 is securely made.

When the cable side guide part 90 further slides in the inserting direction (Xb direction), the arm head end parts 74*a* and 75*a* of the engaging parts 74 and 75 slide and come in contact with the lower surface of the head end of the cable side guide part 90 and are deformed downward. In addition, the contact parts 250*c* of the connector pins 250 are elastically deformed upward.

In addition, when the cable side guide part 90 reaches the inserting completion position of the cable inserting opening 60, the arm head end parts 74*a* and 75*a* of the engaging parts 74 and 75 are engaged with the engaging holes 94 and 95 of the cable side guide part 90 and the terminal part 30 is sandwiched by the contact pressure of the connector pins 50.

A click operation when the head end parts 74*a* and 75*a* of the engaging parts 74 and 75 are engaged with the engaging holes 94 and 95 of the cable side guide part 90 is transferred, as a click feeling, to an operator who grasps the cable side guide part 90, and as a click sound to the ears of the operator.

Thus, according to the flexible cable connecting structure 200, even if the cable side guide part 90 is inserted obliquely from an upper side into the cable inserting opening 60 having an inclination angle α with the horizontal direction, it is possible to guide the cable side guide part 90 so that the cable side guide part 90 is in a horizontal state. As well as a case where the cable side guide part 90 is horizontally inserted, it is possible to insert the cable side guide part 90 to the cable inserting opening in a straight manner.

Figure 12:
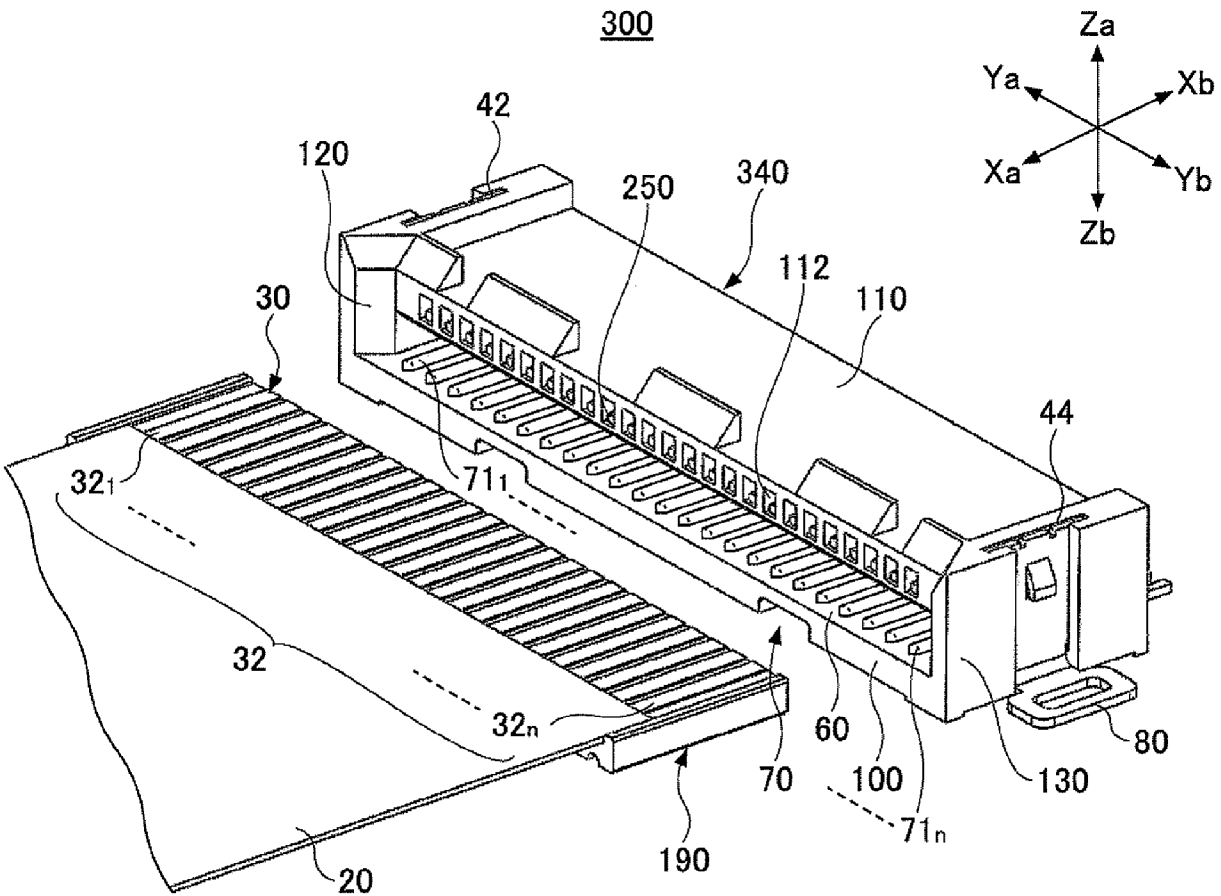
FIG. 12 is an exploded and perspective view of a structure of a modified example.
Figure 13:
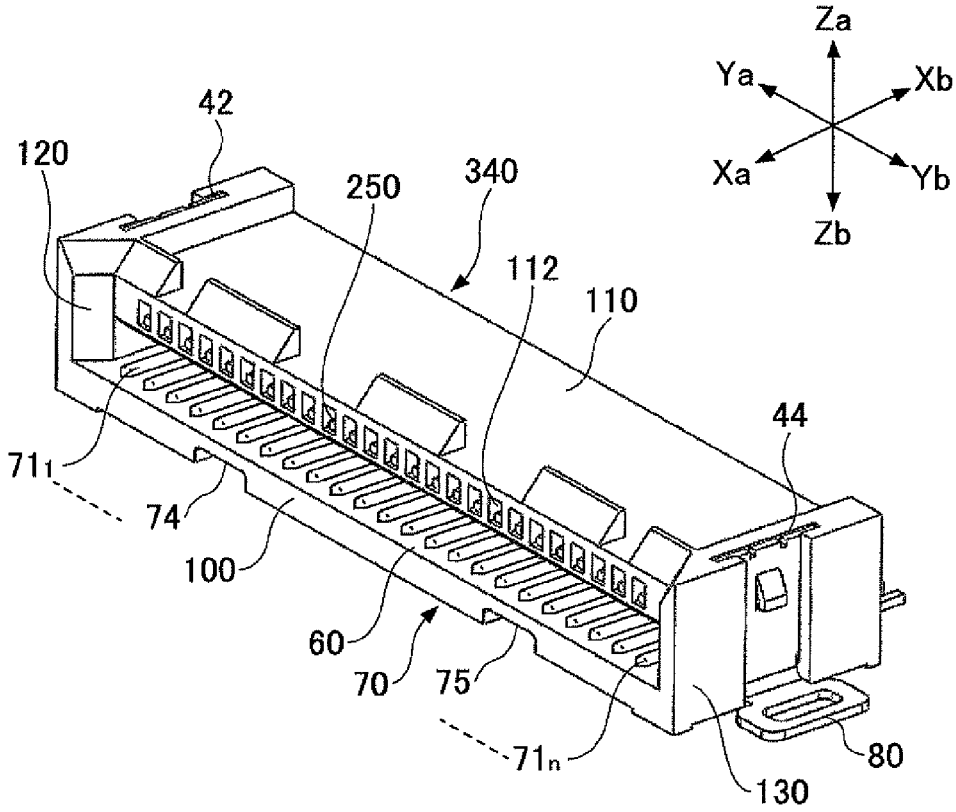
FIG. 13 is a perspective view showing a connector of the modified example.
Figure 14:
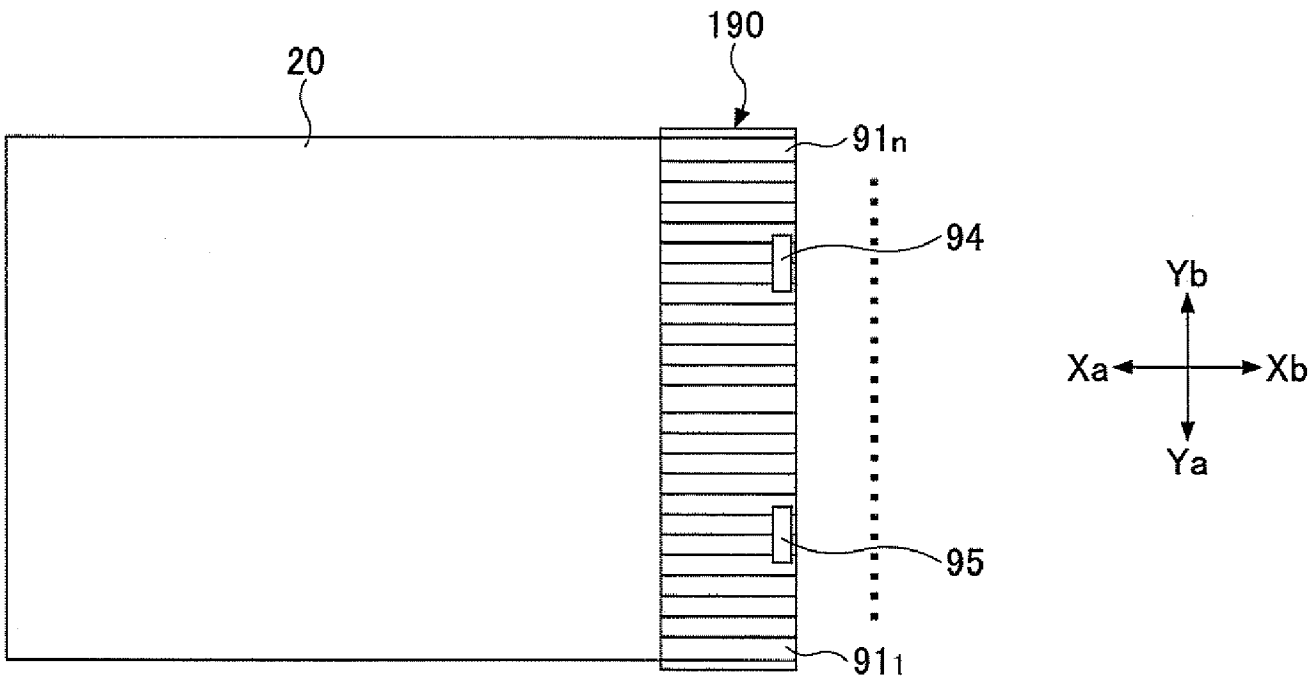
FIG. 14 is a bottom view of the flexible cable seen from a lower side.
Figure 15:
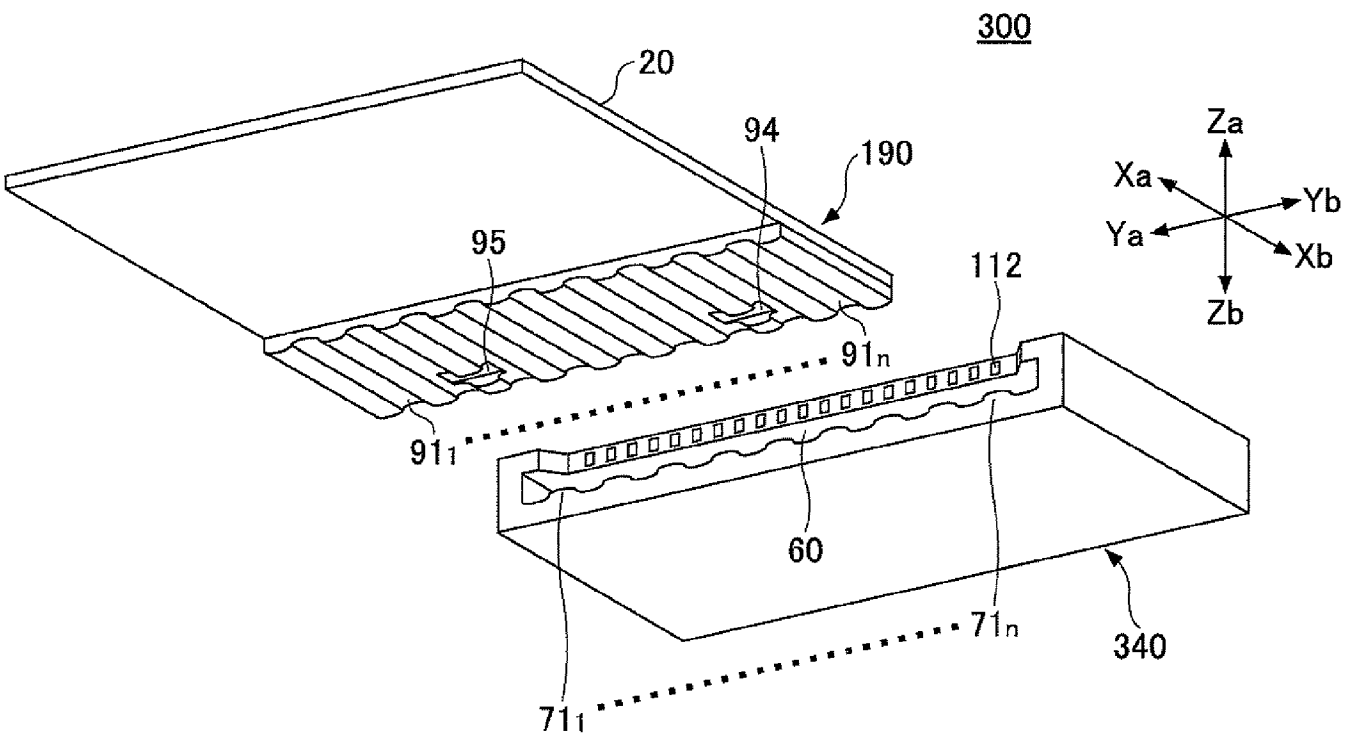
FIG. 15 is an exploded perspective view of the structure of the modified example seen from an obliquely lower side.

Here, modified examples are discussed. FIG. 12 is an exploded perspective view of a structure of a modified example. FIG. 13 is a perspective view showing a connector of the modified example. FIG. 14 is a bottom view of the flexible cable seen from a lower side. FIG. 15 is an exploded perspective view of the structure of the modified example seen obliquely from a lower side. In FIG. 12 through FIG. 15, parts that are the same as the parts discussed in the first embodiment and the second embodiment of the present invention are given the same reference numerals, and explanation thereof is omitted.

As shown in FIG. 12 through FIG. 15, in a flexible cable connecting structure 300 of the modified example, plural guide projecting parts $\mathbf{71}_1$ through $\mathbf{71}_n$ are provided side by side with a designated gap in the horizontal direction (Ya and Yb directions) on the upper surface of the lower part base 100 of a connector 340 so as to extend in the cable inserting and detaching directions (Xa and Xb directions).

In a cable side guide part 190, plural guide grooves $\mathbf{91}_1$ through $\mathbf{91}_n$ engaged with the corresponding plural guide projecting parts $\mathbf{71}_1$ through 71, are provided side by side with the same pitch as that of the plural guide projecting parts $\mathbf{71}_1$ through 71, in the horizontal direction (Ya and Yb directions) at the lower surface so as to extend in the cable inserting and detaching directions (Xa and Xb directions).

Accordingly, when the cable side guide part 190 is inserted in the cable inserting opening 80 of the connector 340, the plural guide projecting parts $\mathbf{71}_1$ through $\mathbf{71}_n$ are simultaneously engaged with the corresponding plural guide grooves $\mathbf{91}_1$ through $\mathbf{91}_n$. Hence, guiding in the cable inserting and detaching directions (Xa and Xb directions) can be securely performed. In addition, even if a horizontal stress acts in the Ya and Yb directions perpendicular to the cable inserting and detaching directions (Xa and Xb directions), strength against the horizontal stress is improved by engagement between the plural guide projecting parts $\mathbf{71}_1$ through $\mathbf{71}_n$ and plural guide grooves $\mathbf{91}_1$ through $\mathbf{91}_n$. Hence, shift of the conductive patterns 32 of the connecting part 30 in the Ya and Yb directions can be prevented. Furthermore, the strength of connection between the flexible cable 20 and the connector 340 can be secured so that the reliability in the connecting state can be improved.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

In the above-discussed embodiments, the FFC (Flexible Flat Cable) is used as the flexible cable 20. However, the present invention is not limited to this example. The present invention can be applied to a flexible cable connecting structure using a flexible cable other than the FFC.

In addition, in the above-discussed embodiments, plural guide grooves are provided in the cable side guide part 190 and plural guide projecting parts are provided in the connectors 40 and 240. However, the present invention is not limited to this example. The present invention can be applied to a structure where plural guide projecting parts are provided in the cable side guide part 190 and plural guide grooves are provided in the connectors 40 and 240.

In addition, in the above-discussed embodiments, the engaging holes are provided in the cable side guide part 190 and the engaging parts are provided in the connectors 40 and 240. However, the present invention is not limited to this example. The present invention can be applied to a structure where the engaging parts are provided in the cable side guide part 190 and the engaging holes are provided in the connectors 40 and 240.

According to the above-discussed embodiments of the present invention, accompanying the cable side guide part being inserted in the cable inserting opening of the connector, the inserting position of the cable side guide part is guided by sliding with the connector side guide part so that the cable side guide part is inserted in the cable inserting and detaching directions in a straight manner. Hence, the positions of the conductive patterns of the terminal part are consistent with the positions of the corresponding connector pins. Hence, the conductive patterns and the connector pins securely come in contact with each other.

In addition, according to the above-discussed embodiments of the present invention, the restricting part of the connector side guide part is engaged with the restricted part of the cable side guide part so that the inserting and detaching directions of the cable side guide part are restricted. Hence, the inserting and detaching directions of the cable side guide part can be consistent with the inserting and detaching directions of the cable inserting opening. Therefore, the flexible cable can be inserted in the connector in a straight manner without the inserting and detaching directions of the cable being inclined against the cable inserting opening.

Furthermore, according to the embodiments of the present invention, the operator can confirm that a state is held where the terminal part of the flexible cable comes in contact with the connector pins in the connector, via a click feeing when the engaging part of the connector side guide part is engaged with the engaged part of the cable side guide part.

What is claimed is:

1. A flexible cable connecting structure, comprising:

a terminal part formed at an end part of a flexible cable, in which conductive patterns of the flexible cable are exposed;

a plurality of connector pins that are provided side by side inside a connector, each of the connector pins being configured to be connected to one of the exposed conductive patterns;

a cable side guide part fixed at a surface of the terminal part so as to expose the conductive patterns; and a connector side guide part provided at a cable inserting opening of the connector, the connector side guide part being configured to guide inserting and detaching of the cable side guide part, wherein the cable side guide part slides on the connector side guide part when the cable side guide part is being inserted into the cable inserting opening of the connector, so that the inserting and detaching of the cable side guide part is guided, and wherein an end part of the connector side guide part extending in a direction perpendicular to an inserting direction of the flexible cable and provided at an entrance of the cable inserting opening is set back toward the inserting direction of the flexible cable relative to a portion of the cable inserting opening located at an opposite side from the connector side guide part, the cable side guide part includes a restricted part formed at a surface of the cable side guide opposite to the surface facing the flexible cable, the restricted part being formed as a projecting part or a groove extending in inserting and detaching directions of the cable side guide; and the connector side guide part includes a restricting part provided only at a portion of the connector side guide part set back toward the inserting direction of the flexible cable and configured to engage with the restricted part of the cable side guide part.

2. The flexible cable connecting structure, as claimed in claim 1, wherein the cable side guide part includes an engaged part formed at a surface of the cable side guide opposite to the surface facing the flexible cable; and the connector side guide part includes an engaging part configured to engage with the engaged part when the cable side guide reaches a position where the conductive patterns are held by a contact pressure of the connector pins.

3. The flexible cable connecting structure, as claimed in claim 1, wherein plural of the restricted parts are provided in parallel with the inserting and detaching directions; and plural of the restricting parts are provided so that the restricting parts are engaged with the corresponding restricted parts.

4. The flexible cable connecting structure, as claimed in claim 2, wherein plural of the engaged parts are provided side by side in a width direction perpendicular to the inserting and detaching directions; and plural of the engaging parts are provided side by side in the width direction perpendicular to the inserting and detaching directions, so that the engaging parts are engaged with the corresponding engaged parts.

5. The flexible cable connecting structure, as claimed in claim 2, wherein the engaging part is provided at an internal wall of the cable inserting opening facing the connector pins.

6. The flexible cable connecting structure, as claimed in claim 1, wherein both of the end part of the upper side of the cable inserting opening and the terminal part of the flexible cable have chamfers so that the flexible cable is obliquely inserted to the cable inserting opening.

7. A cable connector, comprising:

a cable inserting opening where a flexible cable is inserted, the flexible cable includes conductive patterns that are exposed at an end part of the flexible cable and a cable side guide is provided at the end part;

a plurality of connector pins that are provided at an internal wall of the cable inserting opening, each of the connector pins being configured to be connected to one of the exposed conductive patterns; and a connector side guide part configured to guide the cable side guide inserted to and detached from the connector, the cable guide being guided by sliding with the cable side guide part, wherein an end part of the connector side guide part extends in a direction perpendicular to an inserting direction of the flexible cable formed and is provided at an entrance of the cable inserting opening so as to be set back toward the inserting direction of the flexible cable relative to a portion of the cable inserting opening located on an opposite side from the connector side guide part, wherein the connector side guide part includes a restricting part provided only at a portion of the connector side guide part set back toward the inserting direction of the flexible cable and configured to engage with a projecting part or groove of the cable side guide part so as to restrict the inserting and detaching of the cable side guide part.

8. The flexible cable connector, as claimed in claim 7, wherein the connector side guide part includes an engaging part configured to engage with an engaged part of the cable side guide part in a case where the terminal part comes in contact with the connector pins and reaches a position where the terminal part is held by a contact pressure of the connector pins.

* * * * *